US006843218B2

(12) United States Patent
Kumada et al.

(10) Patent No.: US 6,843,218 B2
(45) Date of Patent: Jan. 18, 2005

(54) GLOW PLUG ENERGIZATION CONTROL APPARATUS AND GLOW PLUG ENERGIZATION CONTROL METHOD

(75) Inventors: Chiaki Kumada, Gifu (JP); Shunsuke Gotoh, Nagoya (JP); Takayuki Sakurai, Itomaki (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/765,711

(22) Filed: Jan. 28, 2004

(65) Prior Publication Data

US 2004/0255889 A1 Dec. 23, 2004

(30) Foreign Application Priority Data

Jan. 29, 2003 (JP) ..... P2003-019797

(51) Int. Cl.[7] ..... F02N 17/00
(52) U.S. Cl. ..... 123/179.6; 123/145 A
(58) Field of Search ..... 123/145 A, 143 R, 123/179.6, 179.21, 145 R

(56) References Cited

U.S. PATENT DOCUMENTS 4,391,237 A 7/1983 Abe et al.
4,939,347 A 7/1990 Masaka et al.

FOREIGN PATENT DOCUMENTS

| | | |
|---|---|---|
| DE | 199 36 729 | 11/2000 |
| JP | 56-126674 A | 10/1981 |
| JP | 56-129763 A | 10/1981 |
| JP | 60-067775 A | 4/1985 |
| JP | 2602677 B | 4/1997 |

*Primary Examiner*—Bibhu Mohanty
(74) *Attorney, Agent, or Firm*—Sughrue Mion, PLLC

(57) ABSTRACT

A glow plug energization control apparatus includes a unit for performing an energization control so that a sheath heater is quickly heated when a key switch is put in an on position, a unit for performing, subsequently to this, an energization control to prevent a drop in temperature of the sheath heater, a unit for performing, when the key switch is put in the start position during the energization control, an energization control to prevent a drop in temperature of the sheath heater during its period, and a unit for performing, after the engine is started, an energization control to keep the sheath heater at a second target temperature.

14 Claims, 10 Drawing Sheets

GLOW PLUG ENERGIZATION CONTROL APPARATUS AND GLOW PLUG ENERGIZATION CONTROL METHOD

BACKGROUND OF THE INVENTION

1. Field of the Invention

The present invention relates to a glow plug energization control apparatus for controlling energization to a glow plug for assisting the starting of an internal combustion engine, and a glow plug energization control method.

2. Description of the Related Art

A glow plug generally uses a resistance heater. This glow plug is constructed by attaching the resistance heater to a main body metal fitting, is attached to an engine block of a diesel engine so that a tip of the resistance heater is positioned in a combustion chamber, and is used.

As an apparatus for controlling the energization to such a glow plug, a glow plug energization control apparatus is known. In a conventional glow plug energization control apparatus, when a key switch is put in an on position, the energization to the glow plug is controlled so that the temperature of the resistance heater is raised to a first target temperature (for example, 1000° C.) sufficient to start an engine, and a large electric power is supplied to the glow plug. The step as stated above is generally called a pre-glow or a pre-glow step. In the glow plug which can quickly heat, the temperature of the resistance heater can be raised up to the first target temperature in several seconds. Next, after the temperature of the resistance heater reaches the first target temperature, the energization to the glow plug is controlled so that the temperature of the resistance heater is kept at a second target temperature (for example, 900° C.) for a predetermined period (for example, 180 seconds), and a low electric power is supplied to the glow plug. The state as stated above is generally called an after-glow or an after-glow step. Before the engine is started, the temperature of the resistance heater is kept at the sufficiently high temperature so that the engine can be started at any time, and after the engine is started, warm-up in a combustion chamber of the engine can be accelerated, and it is possible to prevent the occurrence of diesel knock, and to suppress the occurrence of noise and white smoke, the exhaustion of HC composition, and the like.

As documents relating to such a technique, for example, JP-A-56-129763 and JP-A-60-67775 can be named.

However, in the conventional glow plug energization apparatus, there has been a phenomenon in which immediately after the pre-glow step is shifted to the after-glow step, the temperature of the resistance heater becomes once lower than the second target temperature to be kept. It is considered that this is caused since even if the temperature of the resistance heater reaches the first target temperature by the pre-glow step, the temperature of the surrounding of the resistance heater, such as an engine block and a main body metal fitting, is low and these do not yet reach the steady state, so that the temperature of the resistance heater is much absorbed by these. In the state where the temperature of the resistance heater is dropped as stated above, even if a key switch is put in a start position to start cranking, the engine is hard to start.

Besides, when the key switch is put in the start position in the after-glow step and the cranking of the engine is started, also in this case, there has been a phenomenon in which the temperature of the resistance heater becomes lower than the second target temperature to be kept. First, it is considered that this is caused since the resistance heater is cooled by external factors such as burning spray and swirl. Besides, second, it is considered that this is caused since during the cranking, an excessive electric power is required for the cranking, the voltage of a battery is remarkably lowered. Especially, immediately after the shift to the after-glow step, since heat conduction from the resistance heater to the surrounding also occurs as stated above, there has been a problem that the temperature of the resistance heater is remarkably lowered, and the startability of the engine is inferior.

SUMMARY OF THE INVENTION

The present invention has been made in view of such circumstances, and has an object to provide a glow plug energization control apparatus which prevents the temperature of a resistance heater from dropping after a pre-glow step is ended and can improve the startability of an engine, and a glow plug energization control method.

As means for solving the problem, there is provided a glow plug energization control apparatus for controlling energization from a battery to a glow plug having a resistance heater installed in an engine when a key switch is put in an on position or a start position, the glow plug energization control apparatus comprising a pre-glow unit for controlling the energization to the glow plug to quickly raise temperature of the resistance heater when the key switch is put in the on position, an upkeep glow unit for calculating a duty ratio Dh of a voltage waveform applied to the glow plug on the basis of a voltage value applied to the glow plug from the battery subsequently to the energization control performed by the pre-glow unit and for performing PWM control for the energization to the glow plug according to the duty ratio Dh, a cranking glow unit for calculating, in a period of a cranking started by putting the key switch in the start position during the energization control performed by the upkeep glow unit, a duty ratio Dk of a voltage waveform applied to the glow plug on the basis of a voltage value applied to the glow plug from the battery and for performing PWM control for the energization to the glow plug according to the duty ratio Dk larger than a virtual duty ratio Dhh calculated by the upkeep glow unit when it is assumed that the voltage value of the battery in a control period of the upkeep glow unit is equal to the voltage value of the battery in a control period of the cranking glow unit, and an after starting glow unit for, after the engine is started, supplying an electric power, which is lower than an electric power supplied to the glow plug by the pre-glow unit, to the glow plug to realize stable heating of the resistance heater.

According to the invention, the glow plug energization control apparatus includes the four units, that is, the pre-glow unit, the upkeep glow unit, the cranking glow unit and the after starting glow unit.

Among them, the pre-glow unit is for controlling the energization to the glow plug so that when the key switch is put in the on position, the temperature of the resistance heater is quickly raised. By providing the unit as stated above, when the key switch is put in the on position, an average electric power is set to be larger than that of the other units and the energization to the glow plug can be performed. Accordingly, the temperature of the resistance heater can be efficiently raised. Incidentally, the pre-glow unit may continuously apply electricity to the glow plug for a predetermined time irrespective of a battery voltage, or may apply electricity to the glow plug until the accumulated wattage applied to the glow plug becomes a predetermined value corresponding to a first target temperature as described later. In any event, by the control of the pre-glow unit, the temperature of the resistance heater is raised up to the first target temperature or the vicinity thereof.

The upkeep glow unit calculates, subsequently to the energization control performed by the pre-glow unit, the duty ratio Dh of the voltage waveform applied to the glow plug on the basis of the voltage value applied to the glow plug from the battery, and performs the PWM control for the energization to the glow plug according the duty ratio Dh. As described before, in the related art, there has been a problem that immediately after the pre-glow step is shifted to the after-glow step, the temperature of the resistance heater is once dropped by the heat conduction from the resistance heater to the surrounding. On the other hand, according to the invention, the upkeep glow unit is separately provided, and the PWM control is preformed for the energization to the glow plug. That is, in expectation of the occurrence of the heat conduction from the resistance heater to the surrounding after the energization control performed by the pre-glow unit, the energization to the glow plug is controlled. Further, the PWM control has a merit that the electric power applied to the glow plug can be simply adjusted according to the duty ratio Dh. Accordingly, it is possible to prevent the drop in the temperature of the resistance heater and to improve the startability of the engine. Incidentally, when duty ratios Dh corresponding to respective received voltages are determined in advance, a control mode can be made simple.

The cranking glow unit is for calculating the duty ratio Dk of the voltage waveform applied to the glow plug on the basis of the voltage value applied to the glow plug from the battery during the period of the cranking when the key switch is put in the start position and the cranking of the engine is started during the energization control performed by the upkeep glow unit. Besides, the unit is for performing the PWM control for the energization to the glow plug according to the duty ratio Dk larger than the virtual duty ratio Dhh calculated by the upkeep glow unit when it is assumed that the voltage value of the battery in the control period of the upkeep glow unit is equal to the voltage value of the battery in the control period of this unit. As described before, in the related-art energization control apparatus, there has been a problem that during the cranking, by the external factors, such as the burning spray and the swirl, or the drop of the battery voltage by the cranking, the temperature of the resistance heater becomes lower than that in the control period of the upkeep glow unit. On the other hand, according to the invention, the cranking glow unit is separately provided, and the PWM control for the energization to the glow plug is performed. That is, in expectation of the temperature drop of the resistance heater during the cranking period, the energization to the glow plug is controlled. Specifically, the duty ratio Dk calculated by the cranking glow unit is made larger than the virtual duty ratio Dhh calculated in the case where the control by the upkeep glow unit is performed instead, and the energization to the glow plug is controlled. Further, the PWM control has a merit that the electric power applied to the glow plug can be simply adjusted according to the duty ratio Dk. Accordingly, even during the cranking period, it is possible to prevent the drop in the temperature of the resistance heater and to improve the startability of the engine. Incidentally, when duty ratios Dk corresponding to respective received voltages are determined in advance, a control mode can be made simple.

After the engine is started, the after starting glow unit supplies the electric power, which is lower than the electric power supplied to the glow plug by the pre-glow unit, to the glow plug, and realizes the stable heating of the resistance heater. By the unit as stated above, since the heating can be performed while keeping the temperature of the resistance heater stably, the warm-up in the combustion chamber of the engine can be accelerated, and it is possible to prevent the occurrence of diesel knock and to suppress the occurrence of noise and white smoke, the exhaustion of HC composition, and the like.

Further, in the above glow plug energization control apparatus, the pre-glow unit controls the energization to the glow plug until an accumulated wattage applied to the glow plug becomes a predetermined value corresponding to the first target temperature.

As the control by the pre-glow unit, it is conceivable that the temperature of the resistance heater is raised up to the first target temperature by performing the energization to the glow plug for a predetermined time previously set. However, since the battery voltage is not necessarily constant, insufficient preheating of the resistance heater or excessive preheating is apt to occur. In the case of the insufficient preheating, the startability of the engine is influenced, and on the other hand, in the case of the excessive preheating, disadvantages, such as the lowering of lifetime of the resistance heater, disconnection and dissolved loss, are apt to occur. On the other hand, the pre-glow unit of the invention controls the energization to the glow plug until the accumulated wattage to the glow plug becomes the predetermined value corresponding to the first target temperature. When the control is performed by means of the accumulated wattage as stated above, the temperature of the resistance heater can be raised up to the first target temperature more accurately, so that the insufficient heating of the resistance heater or the excessive heating thereof can be effectively suppressed.

Further, in the above glow plug energization control apparatus, the pre-glow unit continuously performs the energization to the glow plug during the control period.

According to the invention, the pre-glow unit continuously performs the energization to the glow plug. By continuously performing the energization as stated above, the temperature of the resistance heater can be raised up to the first target temperature more efficiently and in a short time.

Further, in the above glow plug energization control apparatus, when the key switch is not put in the start position in a predetermined time from the start of the energization control performed by the upkeep glow unit, the upkeep glow unit stops the energization to the glow plug.

According to the invention, when the key switch is not put in the start position in the predetermined time from the start of the energization control, the upkeep glow unit stops the energization to the glow plug. When the energization control by the upkeep glow unit is continued for a long time, the load to the glow plug becomes high, and the battery is apt to go flat. On the other hand, in the case where a long time has passed since the key switch was put in the on position, it is conceivable that the operator does not intend to start the engine. Then, by stopping the energization to the glow plug after the predetermined time has passed as in the invention, the glow plug, the battery and the like can be protected.

Further, in the above glow plug energization control apparatus, the after starting glow unit controls the energization to the glow plug to make the temperature of the resistance heater a second target temperature and to keep this.

According to the invention, the after starting glow unit controls the energization to the glow plug to make the temperature of the resistance heater the second target temperature and to keep this. By this, even after the engine is started, the temperature of the resistance heater can be made the second target temperature and this can be kept, the warm-up in the combustion chamber can be more effectively accelerated, and it is possible to prevent the occurrence of diesel knock and to suppress the occurrence of noise and white smoke, the exhaustion of HC composition, and the like.

Further, in the above glow plug energization control apparatus, the after starting glow unit calculates a duty ratio Da of the voltage waveform applied to the glow plug on the basis of a resistance value of the resistance heater, and performs PWM control for the energization to the glow plug according to the duty ratio Da.

According to the invention, the after starting glow unit calculates the duty ratio Da of the voltage waveform applied to the glow plug on the basis of the resistance value of the resistance heater, and performs the PWM control for the energization to the glow plug according to the duty ratio Da. The PWM control has a merit that the electric power applied to the glow plug can be easily adjusted according to the duty ratio. Here, during the control period of the after starting glow unit, since there is a case where the temperature of the resistance heater is dropped by the external factors such as the burning spray and swirl, it is necessary to stably heating the resistance heater in expectation of this. On the other hand, since the resistance value of the resistance heater during the control period of the after starting glow unit is in a steady state corresponding to the temperature, that is, since there is a correlation between the resistance value of the resistance heater and its temperature, when the duty ratio Da calculated on the basis of the resistance value is used, the heater temperature can be made the second target temperature more accurately, and this can be stably kept. Incidentally, when duty ratios Da corresponding to respective resistance values are determined in advance, the heater temperature can be controlled in a simple control mode.

Further, in the above glow plug energization control apparatus, when a present resistance value of the glow plug is R, a resistance value at a time when the temperature of the resistance heater becomes the second target temperature is Rt, an applied voltage to the glow plug is Vb, a difference $\Delta R$ is given by $\Delta R=Rt-R$, and a control effective voltage value Vc is given by $Vc=K_0+K_1\Delta R+K_2\int\Delta R dt$, the after starting glow unit includes a calculation unit for calculating the duty ratio Da in accordance with $Da=Vc^2/Vb^2$.

According to the invention, when the difference $\Delta R$ of the resistance value of the resistance heater is given by $\Delta R=\Delta Rt-R$, and the control effective voltage value Vc is given by $Vc=K_0+K_1\Delta R+K_2\int\Delta R dt$, the after starting glow unit includes the calculation unit for calculating the duty ratio Da in accordance with $Da=Vc^2/Vb^2$. When the duty ratio Da is calculated in this way, and the energization to the glow plug is controlled, the temperature of the resistance heater during the control performed by the after starting glow unit can be made the second target temperature more accurately, and this can be more stably kept. Incidentally, $K_0$, $K_1$ and $K_2$ denote coefficients.

Further, in the above glow plug energization control apparatus, the glow plug energization control apparatus further comprises a pre-glow priority unit which, when the key switch is put in the start position during the energization control performed by the pre-glow unit, waits for ending of the energization control performed by the pre-glow unit and shifts it to energization control performed by the cranking glow unit.

When the energization control performed by the cranking glow unit is started during the energization control performed by the pre-glow unit, since the applied voltage to the glow plug is dropped in accordance with the drop of the battery voltage, the resistance heater is not sufficiently heated, and there is a case where the startability of the engine is lowered. On the other hand, the invention comprises the pre-glow priority unit which, when the key switch is put in the start position during the energization control performed by the pre-glow unit, waits the ending of the energization control performed by the pre-glow unit and shifts it to the energization control performed by the cranking glow unit. Thus, since the energization control performed by the cranking glow unit is performed after the energization control performed by the pre-glow unit is ended and the resistance heater is sufficiently heated, the engine can be certainly started.

Besides, according to another solving means, there is provided a glow plug energization control method for controlling energization from a battery to a glow plug having a resistance heater installed in an engine when a key switch is put in an on position or a start position, the glow plug energization control method comprising a pre-glow step of controlling the energization to the glow plug to quickly raise temperature of the resistance heater when the key switch is put in the on position, a upkeep glow step of calculating a duty ratio Dh of a voltage waveform applied to the glow plug on the basis of a voltage value applied to the glow plug from the battery subsequently to the pre-glow step and for performing PWM control for the energization to the glow plug according to the duty ratio Dh, a cranking glow step of calculating, in a period of a cranking started by putting the key switch in the start position in the upkeep glow step, a duty ratio Dk of a voltage waveform applied to the glow plug on the basis of a voltage value applied to the glow plug from the battery and performing PWM control for the energization to the glow plug according to the duty ratio Dk larger than a virtual duty ratio Dhh calculated in the upkeep glow step when it is assumed that the voltage value of the battery in the upkeep glow step is equal to the voltage value of the battery in the cranking glow step, and an after starting glow step of, after the engine is started, supplying an electric power, which is lower than an electric power supplied to the glow plug in the pre-glow step, to the glow plug to realize stable heating of the resistance heater.

According to the invention, the glow plug energization control method comprises the four steps, that is, the pre-glow step, the upkeep glow step, the cranking glow step and the after starting glow step.

Among them, at the pre-glow step, the energization to the glow plug is controlled so that when the key switch is put in the on position, the temperature of the resistance heater is quickly raised. By providing the step as stated above, when the key switch is put in the on position, an average electric power is set to be larger than that at the other steps and the energization to the glow plug can be performed. Accordingly, the temperature of the resistance heater can be efficiently raised.

At the upkeep glow step, subsequently to the pre-glow step, the duty ratio Dh of the voltage waveform applied to the glow plug is calculated on the basis of the voltage value applied to the glow plug from the battery, and the PWM control for the energization to the glow plug is performed according the duty ratio Dh. As described before, in the related art, there has been a problem that immediately after the pre-glow step is shifted to the after-glow step, the temperature of the resistance heater is once dropped by the heat conduction from the resistance heater to the surrounding. On the other hand, according to the invention, the upkeep glow step is separately provided, and the PWM control is preformed for the energization to the glow plug. That is, in expectation of the occurrence of the heat conduction from the resistance heater to the surrounding after the energization control at the pre-glow step, the energization to the glow plug is controlled. Further, the PWM control has a merit that the electric power applied to the glow plug can be simply adjusted according to the duty ratio Dh. Accordingly, it is possible to prevent the drop in the temperature of the resistance heater and to improve the startability of the engine.

At the cranking glow step, the duty ratio Dk of the voltage waveform applied to the glow plug is calculated on the basis of the voltage value applied to the glow plug from the battery during the period of the cranking when the key switch is put in the start position and the cranking of the engine is started in the upkeep glow step. Besides, at this step, the PWM control for the energization to the glow plug is performed according to the duty ratio Dk larger than the virtual duty Dhh calculated in the upkeep glow step when it is assumed that the voltage value of the battery in the upkeep glow step is equal to the voltage value of the battery in this step. As described before, in the related art, there has been a problem that during the cranking, by the external factors, such as the burning spray and the swirl, or the drop in the battery voltage by the cranking, the temperature of the resistance heater becomes lower than that in the upkeep glow step. On the other hand, according to the invention, the cranking glow step is separately provided, and the PWM control for the energization to the glow plug is performed. That is, in expectation of the temperature drop of the resistance heater during the cranking period, the energization to the glow plug is controlled. Specifically, the duty ratio Dk calculated in the cranking glow step is made larger than the virtual duty ratio Dhh calculated in the case where the control in the upkeep glow step is performed instead, and the energization to the glow plug is controlled. Further, the PWM control has a merit that the electric power applied to the glow plug can be simply adjusted according to the duty ratio Dk. Accordingly, even during the cranking period, it is possible to prevent the drop in the temperature of the resistance heater and to improve the startability of the engine.

At the after starting glow step, after the engine is started, the electric power, which is lower than the electric power supplied to the glow plug at the pre-glow step, is supplied to the glow plug to realize the stable heating of the resistance heater. By the step as stated above, since the heating can be performed while keeping the temperature of the resistance heater stably, the warm-up in the combustion chamber of the engine can be accelerated, and it is possible to prevent the occurrence of diesel knock and to suppress the occurrence of noise and white smoke, the exhaustion of HC composition, and the like.

Further, in the above glow plug energization control method, at the pre-glow step, the energization to the glow plug is controlled until an accumulated wattage to the glow plug becomes a predetermined value corresponding to a first target temperature.

As the control at the pre-glow step, it is conceivable that the temperature of the resistance heater is raised up to the first target temperature by performing the energization to the glow plug for a predetermined time previously set. However, since the battery voltage is not necessarily constant as described before, insufficient preheating of the resistance heater or excessive preheating is apt to occur. On the other hand, at the pre-glow step of the invention, the energization to the glow plug is controlled until the accumulated wattage to the glow plug becomes the predetermined value corresponding to the first target temperature. When the control is performed by means of the accumulated wattage as stated above, the temperature of the resistance heater can be raised more accurately up to the first target temperature, so that the insufficient heating of the resistance heater or the excessive heating thereof can be effectively suppressed.

Further, in the above glow plug energization control method, at the pre-glow step, continuous energization to the glow plug is performed.

According to the invention, at the pre-glow step, the continuous energization to the glow plug is performed. By performing the continuous energization as stated above, the temperature of the resistance heater can be raised to the first target temperature more efficiently and in a short time.

Further, in the above glow plug energization control method, at the upkeep glow step, when the key switch is not put in the start position in a predetermined time from the start of the upkeep glow step, the energization to the glow plug is stopped.

According to the invention, at the upkeep glow step, when the key switch is not put in the start position in the predetermined time from the start of the step, the energization to the glow plug is stopped. When the energization control at the upkeep glow step is continued for a long time, the load to the glow plug becomes high, and the battery is apt to go flat. On the other hand, in the case where a long time has passed since the key switch was put in the on position, it is conceivable that the operator does not intend to start the engine. Then, by stopping the energization to the glow plug after the predetermined time has passed as in the invention, the glow plug, the battery and the like can be protected.

Further, in the above glow plug energization control method, at the after starting glow step, the energization to the glow plug is controlled to make the temperature of the resistance heater a second target temperature and to keep this.

According to the invention, at the after starting glow step, the energization to the glow plug is controlled to make the temperature of the resistance heater the second target temperature and to keep this. By this, even after the engine is started, the temperature of the resistance heater can be made the second target temperature and this can be kept, the warm-up in the combustion chamber can be more effectively accelerated, and it is possible to prevent the occurrence of diesel knock and to suppress the occurrence of noise and white smoke, the exhaustion of HC composition, and the like.

Further, in the above glow plug energization control method, at the after starting glow step, a duty ratio Da of the voltage waveform applied to the glow plug is calculated on the basis of the resistance value of the resistance heater, and the PWM control for the energization to the glow plug is performed according to the duty ratio Da.

According to the invention, at the after starting glow step, the duty ratio Da of the waveform of the voltage applied to the glow plug is calculated on the basis of the resistance value of the resistance heater, and the PWM control for the energization to the glow plug is performed according to the duty ratio Da. The PWM control has a merit that the electric power inputted to the glow plug can be easily adjusted according to the duty ratio. Here, in the after starting glow step, since there is a case where the temperature of the resistance heater is dropped by the external factors such as the burning spray and swirl, it is necessary to stably heating the resistance heater in expectation of this. On the other hand, since the resistance value of the resistance heater in the after starting glow step is in a steady state corresponding to the temperature, that is, since there is a correlation between the resistance value of the resistance heater and its temperature, when the duty ratio Da calculated on the basis of the resistance value is used, the heater temperature can be made the second target temperature more accurately, and this can be stably kept.

Further, in the above glow plug energization control method, when a present resistance value of the glow plug is R, a resistance value at a time when the temperature of the resistance heater becomes the second target temperature is Rt, an applied voltage to the glow plug is Vb, a difference $\Delta R$ is given by $\Delta R=Rt-R$, and a control effective voltage value Vc is given by $Vc=K_0+K_1\Delta R+K_2\int\Delta Rdt$, the after starting glow step includes a calculation step of calculating the duty ratio Da in accordance with $Da=Vc^2/Vb^2$.

According to the invention, when the difference $\Delta R$ of the resistance value of the resistance heater is given by $\Delta R=\Delta Rt-R$, and the control effective voltage value Vc is given by $Vc=K_0+K_1\Delta R+K_2\int\Delta Rdt$, the after starting glow step includes the calculation step of calculating the duty ratio Da in accordance with $Da=Vc^2/Vb^2$. When the duty ratio Da is calculated in this way, and the energization to the glow plug is controlled, the temperature of the resistance heater in the after starting glow step can be made the second target temperature more accurately, and this can be more stably kept. Incidentally, $K_0$, $K_1$ and $K_2$ denote coefficients.

Further, in the above glow plug energization control method, when the key switch is put in the start position in the pre-glow step, after the pre-glow step has been ended, it is shifted to the cranking glow step.

When the energization control by the cranking glow step is started in the pre-glow step, since the applied voltage to the glow plug is dropped in accordance with the drop of the battery voltage, the resistance heater is not sufficiently heated, and the startability of the engine is lowered. On the other hand, according to the invention, when the key switch is put in the start position in the pre-glow step, after the pre-glow step has been ended, it is shifted to the cranking glow step. Thus, since the cranking glow step is performed after the pre-glow step is ended and the resistance heater is sufficiently heated, the engine can be certainly started.

DETAILED DESCRIPTION OF THE INVENTION

Hereinafter, an embodiment of the present invention will be described with reference to the drawings.

Figure 2:
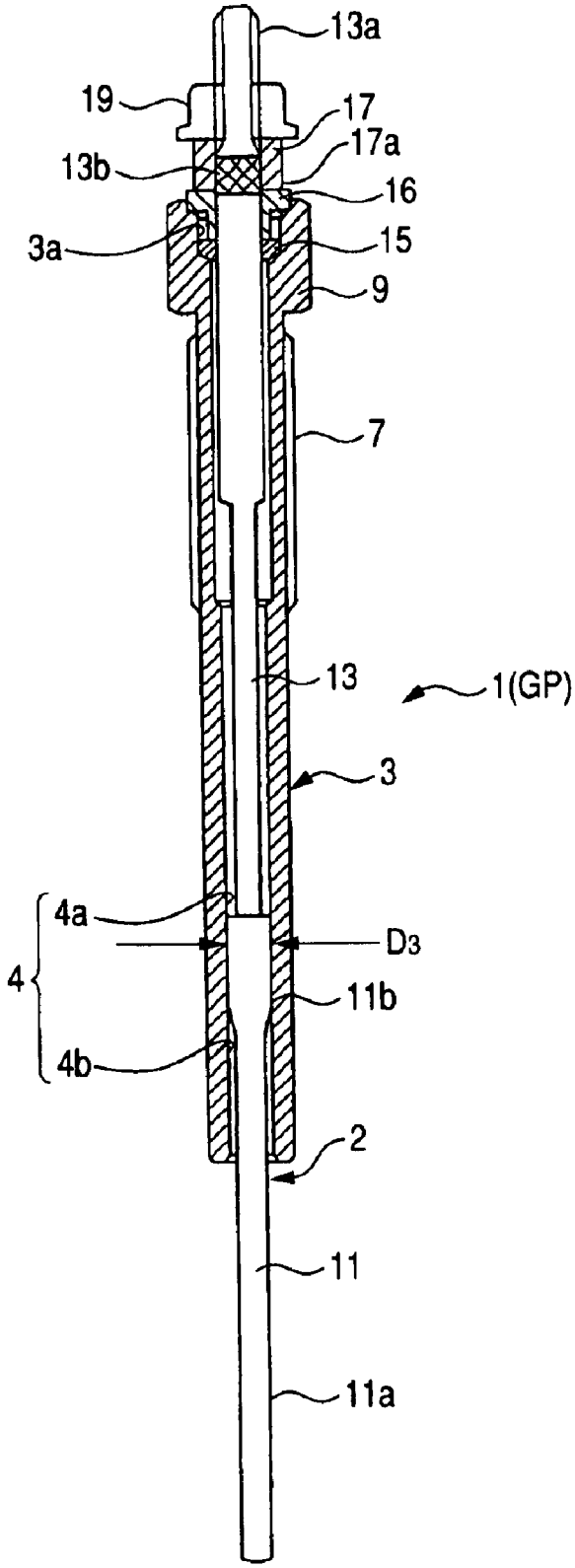
FIG. 2 is a sectional view of a glow plug used in the embodiment.
Figure 3A:
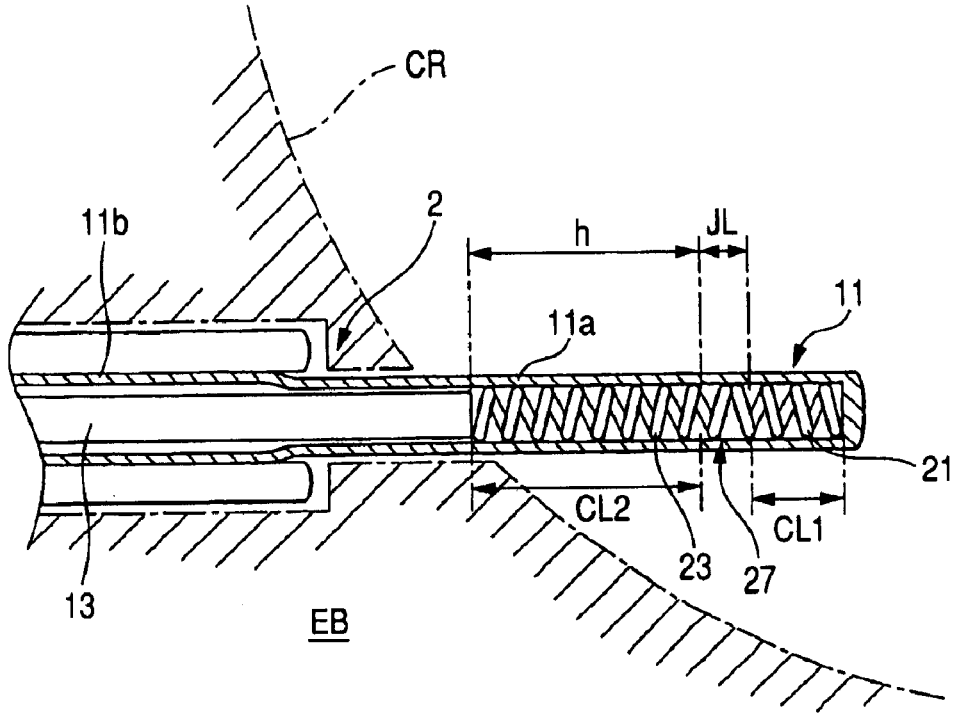
FIGS. 3A and 3B are partial sectional views showing a state in which the glow plug is attached to an engine.
Figure 3B:
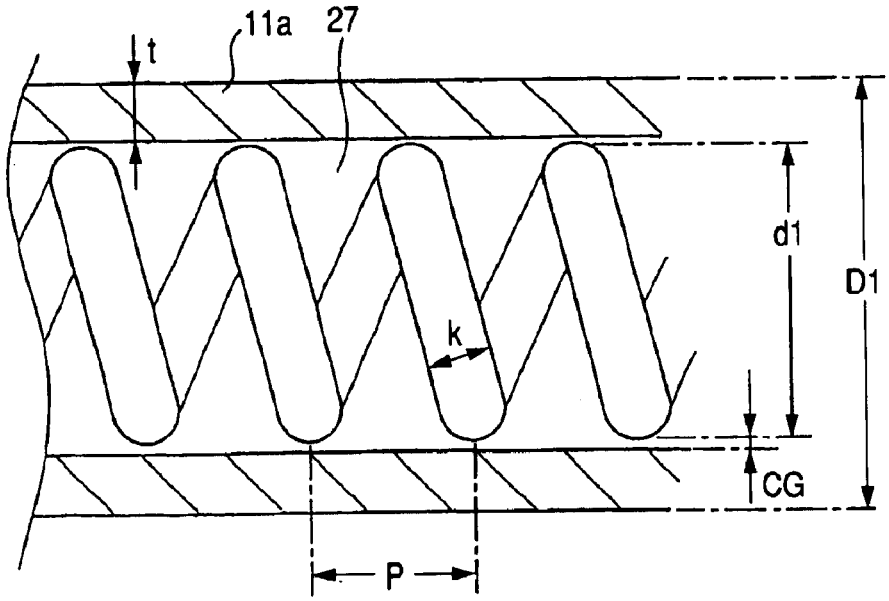

First, a description will be given to a glow plug 1 whose energization is controlled by a glow plug energization control apparatus 101 of the invention. FIG. 2 is a sectional view of the glow plug 1. FIGS. 3A and 3B show a state in which the glow plug 1 is installed in an engine block EB of a diesel engine and others. The glow plug 1 includes a sheath heater 2 constructed as a resistance heater and a main body metal fitting 3 disposed at the outside thereof. As shown in FIG. 3A, in the inside of a sheath tube 11 having a closed tip end, the sheath heater 2 includes plural, two in this embodiment, resistance wire coils, that is, a heat generating coil 21 disposed at a tip end side and a control coil 23 series connected to its rear end, and is sealed together with a magnesium powder 27 as an insulating material. As shown in FIG. 2, a main body part 11*a* of the sheath tube 11 houses the heat generating coil 21 and the control coil 23 and its tip end side protrudes from the main body metal fitting 3. As shown in FIG. 3A, although the heat generating coil 21 is electrically connected to the sheath tube 11 at its tip side, the outer peripheries of the heat generating coil 21 and the control coil 23 and the inner peripheral surface of the sheath tube 11 are in an insulating state by the magnesium powder 27.

Among them, the heat generating coil 21 is formed of, for example, such a material that electrical resistivity R20 at 20° C. is from 80 $\mu\Omega$.cm to 200 $\mu\Omega$.cm and when electrical resistivity at 1000° C. is made R1000, R1000/R20 is from 0.8 to 3, and specifically, it is formed of Fe-Cr alloy, Ni-Cr alloy or the like. On the other hand, the control coil 23 is formed of, for example, such a material that electrical resistivity R20 at 20° C. is from 5 $\mu\Omega$.cm to 20 $\mu\Omega$.cm, and when electrical resistivity at 1000° C. is made R1000, R1000/R20 is from 6 to 20, and specifically, it is formed of Ni, Co-Fe alloy, Co-Ni-Fe alloy or the like.

A rod-like energization terminal shaft 13 is inserted in the sheath tube 11 from its base end side, and its tip end is connected to a rear end of the control coil 23 by welding or the like. On the other hand, as shown in FIG. 2, a male screw part 13*a* is formed at a rear end part of the energization terminal shaft 13. Besides, the main body metal fitting 3 is formed into a tube shape having a through hole 4 in an axial direction, and the sheath heater 2 is inserted and fixed here in a state where the tip end side of the sheath tube 11 is protruded by a predetermined length from one opening end. A tool engagement part 9 having a hexagonal sectional shape for engaging with a tool such as a torque wrench when the glow plug 1 is attached to a diesel engine is formed on the outer peripheral surface of the main body metal fitting 3, and a screw part 7 for attachment is formed to be continuous with this.

The through hole 4 of the main body metal fitting 3 includes a large diameter part 4*b* positioned at an opening side where the sheath tube 11 protrudes, and a small diameter part 4*a* continuous with this, and a large diameter part 11*b* formed at the base end side of the sheath tube 11 is press-fitted in the small diameter part 4*a* and is fixed. On the other hand, a spot facing part 3*a* is formed at the opening part of the through hole 4 at the opposite side, and an O-ring 15 made of rubber and externally covering the energization terminal shaft 13 and an insulating bush 16 (made of, for example, nylon) are fitted here. Then, a press ring 17 for preventing the insulating bush 16 from falling off is mounted to the energization terminal shaft 13 at the rear side thereof. This press ring 17 is fixed to the energization terminal shaft 13 by a crimping portion 17*a* formed at the outer peripheral surface, and a knurling part 13*b* for raising a crimping coupling force is formed on a surface corresponding to the energization terminal shaft 13. Incidentally, reference numeral 19 denotes a nut for fixing a cable for energization to the energization terminal shaft 13.

As shown in FIG. 3A, the glow plug 1 is attached to a plug hole of the engine block EB of the diesel engine or the like by the screw part 7 of the main body metal fitting 3. The tip end part of the sheath heater 2 protrudes into an engine combustion chamber CR by a specific length. Almost the whole of the control coil 23 is positioned in the engine combustion chamber CR. Besides, since the heat generating coil 21 is series connected to the tip end side of the control coil 23, the whole is positioned in the engine combustion chamber CR.

It is ensured that a protrusion length h of the control coil 23 protruding from the inside surface of the engine combustion chamber CR is 3 mm or more. Incidentally, this protrusion length h is generally set to be 10 mm or less. In the present specification, a three-dimensional geometrical barycentric position of the plug hole opening periphery of the inner surface of the combustion chamber CR is made a start point, and the protrusion length h is defined by the protrusion length of the coil center axial line from that. However, in the case where the plug hole opening side is made an enlarged diameter part by a taper surface or a spot facing, the periphery of a starting bottom of the enlarged diameter part is defined as the plug hole opening periphery. Besides, in the case where the whole of the control coil 23 is positioned outside the plug hole, the whole length of the control coil 23 is the projection length h.

A description will be given to experimental results as to what effects are obtained by adopting an attachment mode in which the control coil 23 is protruded from the inner surface of the engine combustion chamber CR as stated above. First, the details of the respective coils 21 and 23 will be described below (see FIGS. 3A and 3B as to symbols denoting sizes of the respective coils 21 and 23)

(Heat generating coil 21)

Material: iron-chromium alloy (composition: Al=7.5 wt %; Cr=26 wt %; Fe=remainder).

Size: coil thickness k=0.3 mm, coil center axial line length CL1=2 mm, coil outer diameter d1=2 mm, pitch P=0.8 mm, R20=0.25 Ω, R1000/R20=1.

(Control coil 23)

Material: cobalt-nickel-iron alloy (composition: Ni=25 wt %; Fe=4 wt %; Co=remainder).

Size: coil thickness k=0.22 mm, coil center axial line length CL2=3 mm, coil outer diameter d1=2 mm, pitch P=0.8 mm, R20=0.1 Ω, R1000/R20=9.

(Inter-coil gap 25)

JL: 2 mm (Sheath tube 11)

Material: SUS310S

Size: outer diameter D1 of the main body part 11*a* is D1=3.5 mm, thickness t=0.5 mm, distance CG from the inner surface of the main body part 11*a* to the heat generating coil 21 (or the control coil 23) is CG=0.25 mm.

This specimen is mounted in a plug hole for test formed in a block made of carbon steel. The projection length (corresponding to h of FIG. 3) of the control coil 23 from a block surface (corresponding to the inner surface of the combustion chamber) is 3 mm in an example and 0 mm in a comparative example. Then, while the projection part of the sheath heater 2 from the block surface is put in a windless state and in an air blasting state of a wind velocity of 4 m/s (weak wind) or 6 m/s (strong wind) by an air blower, target values of energization resistance values are variously set and energization is performed by the PWM system at an after starting glow step as described later, and the energization resistance value of the sheath heater 2 is measured from the values of current and voltage, and saturation temperature is measured by a thermocouple brought into contact with the surface of the sheath tube 11.

As a result, in the example, in any case of the windless state, the weak wind and the strong wind, the saturation temperature of the sheath heater 2 is uniquely determined in accordance with the energization resistance value. This means that even if the influence of cooling by a combustion gas or the like is given, the change of the resistance value of the control coil 23 quickly occurs in a tracking manner, and stable resistance control is realized.

On the other hand, the comparative example indicates such a tendency that the relation between the energization resistance value and the saturation temperature is different among the respective cases of the windless state, the weak wind and the strong wind, and even if the energization resistance values are equal to each other, the saturation temperatures of the sheath heater 2 are not necessarily equal to each other. It is considered that this is because the whole of the control coil 23 is buried in the block, so that the influence of cooling is hardly given on the control coil 23, and the resistance value of the control coil 23 does not change in a tracking manner.

Next, the glow plug energization control apparatus 101 of the invention will be described.

Figure 1:
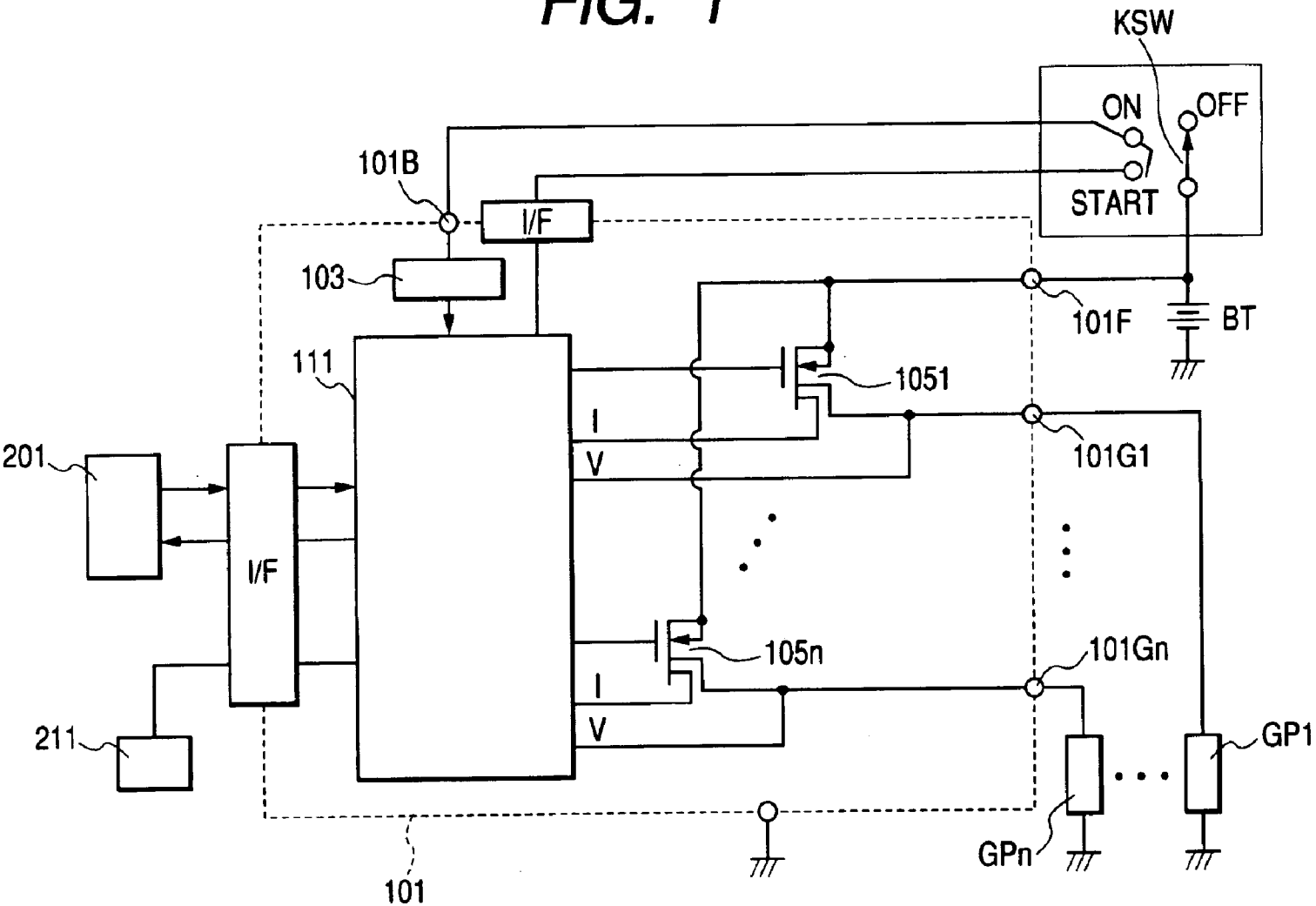
FIG. 1 is a circuit diagram showing a glow plug energization control apparatus of an embodiment.

FIG. 1 is a block diagram showing the electrical structure of the glow plug energization control apparatus 101.

A main control part 111 receives a stable operation voltage for signal processing through a power supply circuit 103. Besides, the power supply circuit 103 receives electric power from a battery BT through a key switch KSW and a terminal 101B. Accordingly, when the key switch KSW is put in the on position or the start position, the electric power is supplied to the power supply circuit 103, and the main control part 111 is operated. On the other hand, when the key switch KSW is turned OFF, the electric power supply to the power supply circuit 103 is stopped, and the main control part 111 stops the operation.

Besides, the electric power of the battery BT is supplied to each of n switching elements 1051 to 105*n* through a terminal 101F. Each of the switching elements 1051 to 105*n* is constructed of a FET in this example, and the voltage of the battery BT is supplied to a drain of the FET. The sources of the respective FETs are connected to plural (n) glow plugs GP1 to GPn through respective terminals 101G1 to 101Gn. Besides, switching signals from the main control part 111 are inputted to gates of the respective FETs, and energization to the respective glow plugs GP1 to GPn is turned ON/OFF. Besides, the FET constituting each of the switching elements 1051 to 105*n* is made of the FET with a current detection function (PROFET (trade mark) made by Infineon Technologies AG) in this example, and a current signal is outputted to the main control part 111 from this.

Applied voltages from the battery BT to the respective glow plugs GP1 to GPn and energization currents to the glow plugs GP1 to GPn are inputted to the main control part 111. The magnitudes of the applied voltages to the glow plugs GP1 to GPn and the energization currents to the glow plugs GP1 to GPn, which are inputted to the main control part 111, are digitized by a not-shown A/D converter.

Besides, the main control part 111 can communicate with an engine control unit 201 (Engine Control Unit: hereinafter also referred to as ECU) constructed of a microcomputer. Besides, the main control part 111 is constructed such that a driving signal of an alternator 211 can be inputted.

Next, an energization control for the glow plug 1 by the glow plug energization control apparatus 101 will be described with reference to the flowcharts shown in FIGS. 4 to 10.

In this energization control, the following operation is basically performed. That is, when the operator puts the key switch in the on position, a pre-glow step starts at which a control is performed by a pre-glow unit. That is, the voltage of the battery BT is directly applied to the glow plug 1, and the sheath heater 2 is heated in a short time up to a first target temperature (for example, 1000° C.). Thereafter, a shift is made to a upkeep glow step controlled by an upkeep glow unit. That is, on the basis of the applied voltage of the glow plug 1, a PWM control is performed for the energization to the glow plug 1, and a drop in the temperature of the sheath heater 2 is suppressed. When the operator puts the key switch KSW in the start position in the upkeep glow step, a shift is made to a cranking glow step at which a control is performed by a cranking glow unit. That is, on the basis of the applied voltage of the glow plug 1, a PWM control is performed for the energization to the glow plug 1, a drop in the temperature of the sheath heater 2 is suppressed, and the startability of the engine is improved. After the engine is started, a shift is made to an after starting glow step at which a control is performed by an after starting glow unit, the temperature of the sheath heater 2 is controlled for a predetermined time (for example, 180 seconds), the temperature is made a second target temperature (for example, 900° C.), and this is kept.

Figure 4:
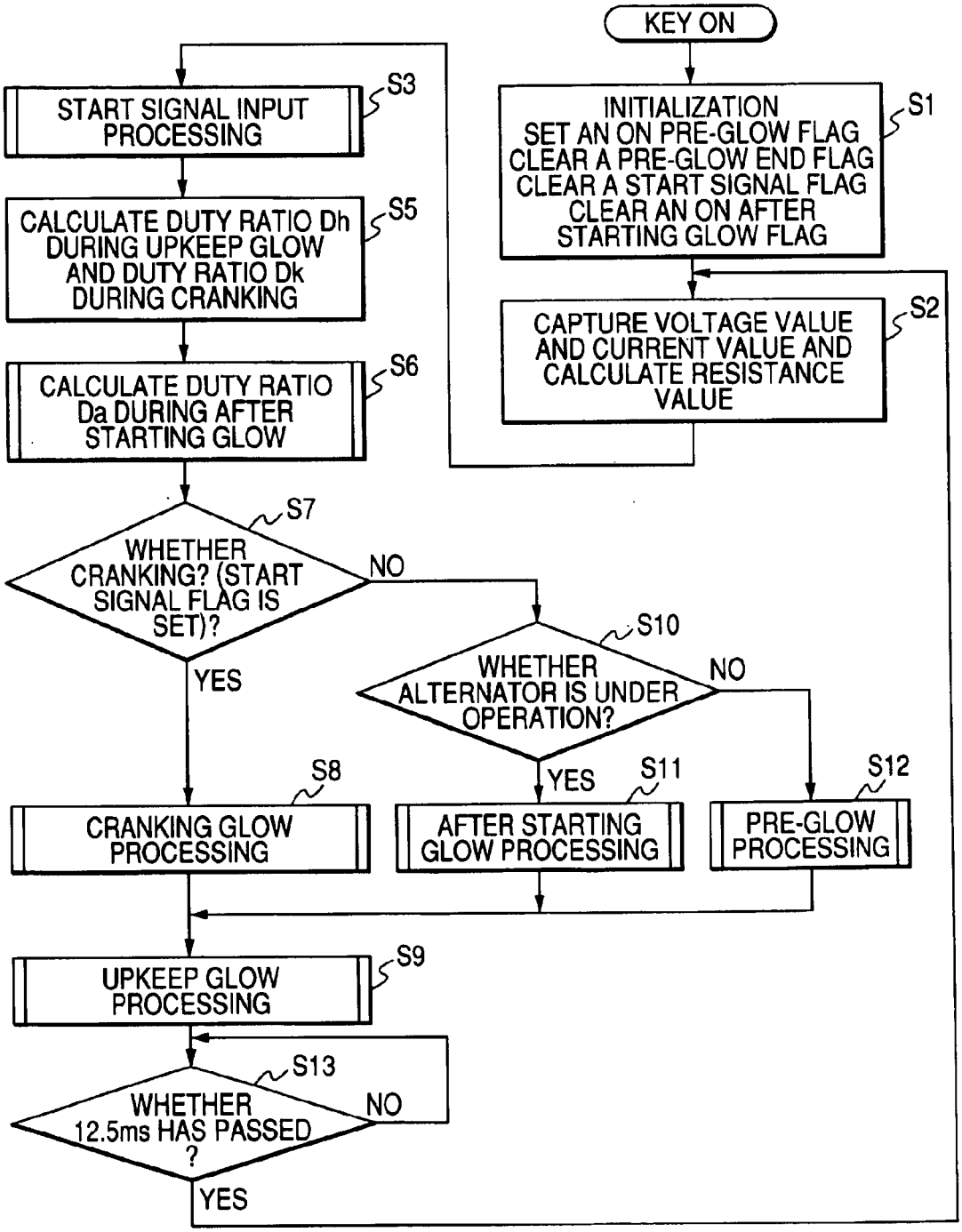
FIG. 4 is a flowchart showing an energization control by the glow plug energization control apparatus of the embodiment.
Figure 5:
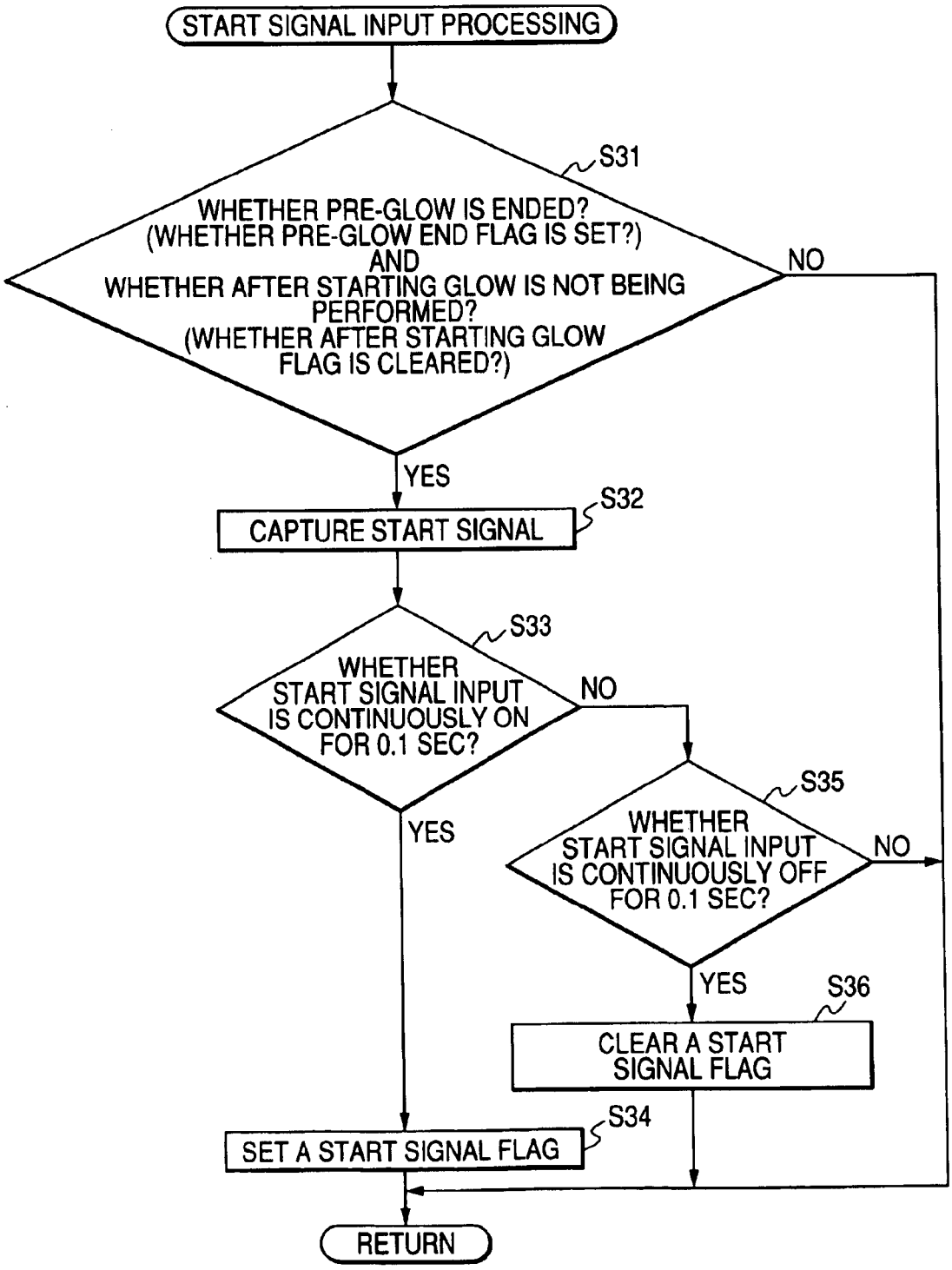
FIG. 5 is a flowchart showing a start signal input processing in the energization control by the glow plug energization control apparatus of the embodiment.
Figure 6:
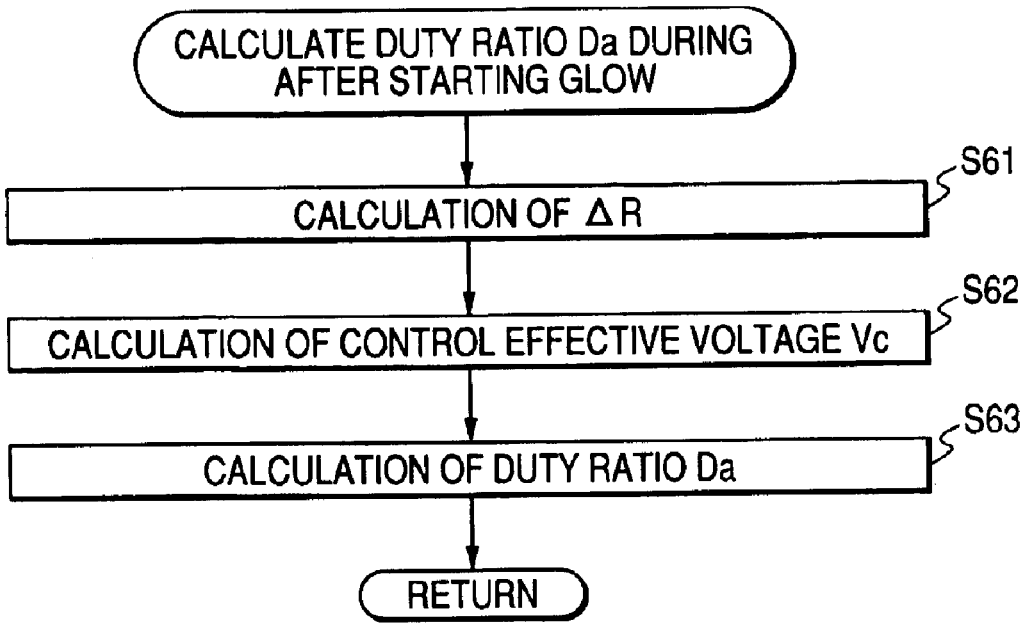
FIG. 6 is a flowchart showing a duty ratio Da calculation during the after starting glow in the energization control by the glow plug energization control apparatus of the embodiment.
Figure 7:
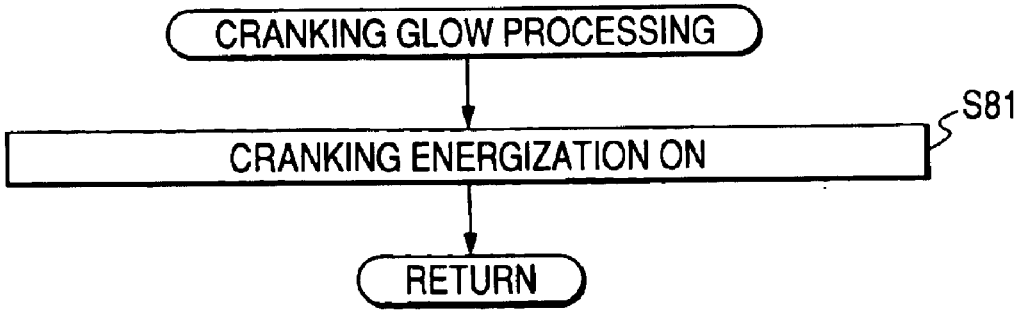
FIG. 7 is a flowchart showing a cranking glow processing in the energization control by the glow plug energization control apparatus of the embodiment.

As shown in FIG. 4, when the key switch KSW is put in the on position, electric power is supplied to the main control part 111, and specifically, a driving voltage is applied from the battery BT through the key switch KSW, the terminal 101B, and the power supply circuit 103 to the main control part 111, and the main control part 111 starts to operate in accordance with a predetermined procedure. Then, first, at step S1, a program of the main control part 111 is initialized. For example, an accumulated wattage Gw to the glow plug 1 is made Gw=0. Besides, an pre-glow flag (flag indicating that the pre-glow step is being performed) is set. On the other hand, a pre-glow end flag (flag indicating that the pre-glow step is ended), a start signal flag (flag indicating that the key switch KSW is put in the start position), and an after starting glow flag (flag indicating that the after starting glow step is being performed) are respectively cleared.

Next, at step S2, a voltage value applied to the glow plug 1 from the battery BT, and a value of current flowing to the glow plug 1 through the respective switching elements 1051 to 105*n* are captured. Then, a present resistance value R of the sheath heater 2 is calculated from the voltage value and the current value.

Next, at step S3, an input processing of a start signal is performed. That is, a procedure proceeds to a subroutine of the start signal input processing shown in FIG. 5. Specifically, first, at step S31, it is judged whether the pre-glow step is ended, and whether the after starting glow step is not being performed. That is, it is judged whether the pre-glow end flag is set, and the after starting glow flag is cleared. Here, when the judgment is YES, that is, in the case where the pre-glow step is ended, and the after starting glow step is not being performed, the procedure proceeds to step S32. That is, in the case where the upkeep glow step is being performed or the cranking glow step is being performed, the procedure proceeds to the step S32. On the other hand, when the judgment is NO, that is, in the case where the pre-glow step is not ended, or the after starting glow step is being performed, the procedure returns to the main routine as it is. That is, in the case where the pre-glow step is being performed or the after starting glow step is being performed, the procedure returns to the main routine as it is.

In the case where the procedure proceeds to the step S32, first, the start signal is captured. Then, the procedure proceeds to step S33, and it is judged whether the input of the start signal is continuously on for 0.1 sec, specifically, whether the input of the start signal is continuously on for eight periods. That is, it is judged whether the key switch KSW is put in the start position. The reason why the input is continuously checked for 0.1 sec is to exclude such a case that an erroneous start signal due to noise or the like is inputted. Here, when the judgment is YES, that is, in the case where the input of the start signal is continuously on for 0.1 sec (in the case where the key switch KSW is put in the start position), the procedure proceeds to step S34, and the start signal flag is set. Then, the procedure returns to the main routine. On the other hand, when the judgment is NO, that is, in the case where the input of the start signal is not continuously on for 0.1 sec (in the case where the key switch is not put in the start position), the procedure proceeds to step S35. At the step S35, it is judged whether the input of the start signal is continuously off for 0.1 sec, specifically, whether the input of the start signal is continuously off for eight periods. That is, it is judged whether the key switch KSW is not put in the start position. Here, when the judgment is YES, that is, in the case where the input of the start signal is continuously off for 0.1 sec (in the case where the key switch KSW is not put in the start position), the procedure proceeds to step S36, and the start signal flag is cleared. On the other hand, when the judgment is NO, that is, in the case where the input of the start signal is not continuously off for 0.1 sec, the procedure returns to the main routine.

Next, at step S5 of the main routine of FIG. 4, a duty ratio Dh to be referred to in the upkeep glow step and a duty ratio Dk to be referred to in the cranking glow step are calculated. Specifically, with respect to the upkeep glow step, the duty ratio Dh of the voltage waveform applied to the glow plug 1 is calculated on the basis of the voltage value applied to the glow plug 1. For example, a table or a function showing relations between voltage values applied to the glow plug 1 and duty ratios Dh is prepared, and the duty ratio Dh may be determined by referring to this. Similarly, also with respect to the cranking glow step, the duty ratio Dk of the voltage waveform applied to the glow plug 1 is calculated on the basis of the voltage value applied to the glow plug 1. For example, a table or a function showing relations between voltage values applied to the glow plug 1 and duty ratios Dk is prepared, and the duty ratio Dh may be determined by referring to this.

Incidentally, when it is assumed that the voltage value applied to the glow plug 1 at the upkeep glow step is equal to the voltage value applied to the glow plug 1 at the cranking glow step, the duty ratio Dk to be referred to in the cranking glow step is larger than the virtual duty ratio Dhh to be referred to in the upkeep glow step.

Next, at step S6, a duty ratio Da to be referred to in the after starting glow step is calculated. That is, the procedure proceeds to a subroutine shown in FIG. 6. Here, first, at step S61, a difference $\Delta R$ of the resistance value of the sheath heater 2 is calculated. Specifically, when a present resistance value of the sheath heater 2 is made R, and a resistance value at the time when the sheath heater 2 becomes the second target temperature is made Rt, the error $\Delta R$ of the resistance value is given by $\Delta R=Rt-R$. Next, the procedure proceeds to step S62, and a control effective voltage value Vc is calculated. Specifically, the control effective voltage value Vc is given by $Vc=K_0+K_1\Delta R+K_2\int\Delta Rdt$. Incidentally, $K_0$, $K_1$ and $K_2$ are constants, and $K_0$, $K_1$ and $K_2>0$. Subsequently, the procedure proceeds to step S63, and the duty ratio Da is calculated. Specifically, the duty ratio Da is calculated in accordance with $Da=Vc^2/Vb^2$. Incidentally, Vb denotes the voltage value (glow voltage) captured at the step S2.

Next, at step S7 of the main routine of FIG. 4, it is judged whether cranking is being performed. That is, it is judged whether the start signal flag is set. Here, when the judgment is YES, that is, in the case where the cranking is being performed (in the case where the start signal input flag is set), the procedure proceeds to step S8. On the other hand, when the judgment is No, that is, in the case where the cranking is not being performed (in the case where the start signal input flag is cleared), the procedure proceeds to step S10.

In the case where the procedure proceeds to the step S8, a cranking glow processing is performed. That is, the procedure proceeds to a subroutine shown in FIG. 7. Here, at step S81, cranking energization is turned on. That is, according to the duty ratio Dk calculated at the step S5, the PWM control is performed for the energization to the glow plug 1. Thereafter, the procedure returns to the main routine.

Next, in the case where the procedure proceeds to the step S10 from the step S7 in the main routine of FIG. 4, it is judged whether the alternator is under operation.

Here, when the judgment is YES, that is, in the case where the alternator is under operation, the procedure proceeds to an after starting glow processing of step S11. That is, the procedure proceeds to a subroutine shown in FIG. 8. Here, first, at step S111, it is judged whether a predetermined time (for example, 180 seconds) of the after starting glow step has passed. Specifically, it is judged whether a counter, which counts up at step S112 described later, has come to have a predetermined value. Here, when the judgment is NO, that is, in the case where the after starting glow time has not passed, the procedure proceeds to the step S112. Then, at the step S112, the after starting glow energization is turned on, and the after starting glow flag is set. Besides, as stated above, the after starting glow time is counted up. In the after starting glow energization, the PWM control is performed for the energization to the glow plug 1 according to the duty ratio Da calculated at the step S6, and in the case where the temperature of the sheath heater 2 has not yet become the second target temperature, this temperature is made to become the second target temperature, or in the case where it has already become the second target temperature, this temperature is kept. Thereafter, the procedure returns to the main routine, and the procedure proceeds to step S9. On the other hand, at the step S111, when the judgment is YES, that is, in the case where the after starting glow time has passed, the procedure proceeds to step S113. Then, at the step S113, the after starting glow energization is turned off, and the after starting glow flag is cleared. Thereafter, the procedure returns to the main routine, and the procedure proceeds to the step S9.

Next, a description will be given to a case where the judgment is NO at the step S10, that is, the alternator is not under operation. In this case, the procedure proceeds to a pre-glow processing of step S12. That is, the procedure proceeds to a subroutine shown in FIG. 9. Here, first, at step S121, it is judged whether the pre-glow step is being performed. That is, it is judged whether the pre-glow flag is set. Here, when the judgment is YES, that is, in the case where the pre-glow step is being performed (in the case where the pre-glow flag is set), the procedure proceeds to step S122, and a wattage (Gw1) applied to the glow plug 1 during the period of one cycle is calculated. Next, the procedure proceeds to step S123, and the accumulated wattage (Gw) of the glow plug 1 is calculated. That is, the newly applied wattage Gw1 is added to the previous accumulated wattage Gw to obtain the new accumulated wattage Gw.

Next, at step S124, it is judged whether the accumulated wattage Gw exceeds a target input corresponding to the first target temperature. Here, when the judgment is NO, that is, in the case where the accumulated wattage Gw does not exceed the target input, the procedure proceeds to step S126, and the pre-glow energization is turned on. Specifically, continuous energization to the glow plug 1 is performed. Thereafter, the procedure returns to the main routine. On the other hand, at the step S124, when the judgment is YES, that is, the accumulated wattage Gw exceeds the target input, the procedure proceeds to step S125, and the pre-glow energization is turned off. Besides, the pre-glow flag is cleared, while the pre-glow end flag is set. Thereafter, the procedure returns to the main routine.

Incidentally, at the judgment of the step S121, when the judgment is NO, that is, in the case where it is judged that the pre-glow step is not being performed (in the case where the pre-glow flag is not set), the procedure returns to the main routine as it is, and the procedure proceeds to step S9.

Next, at the step S9 of the main routine, a upkeep glow processing is performed. That is, the procedure proceeds to a subroutine shown in FIG. 10. Here, first, at step S91, it is judged whether the cranking step is being performed or the after starting glow step is being performed. That is, it is judged whether the start signal flag is set or the after starting glow flag is set. Here, when the judgment is YES, that is, in the case where the cranking is being performed (in the case where the start signal flag is set) or in the case where the after starting glow step is being performed (in the case where the after starting glow flag is set), the procedure proceeds to step S97, and upkeep glow energization is turned off. Then, the procedure returns to the main routine.

On the other hand, at the step S91, when the judgment is NO, that is, in the case where the cranking is not being performed (the start signal flag is cleared) and the after starting glow is not also being performed (the after starting glow flag is also cleared), the procedure proceeds to step S92. At the step S92, it is judged whether a upkeep glow time (predetermined time of the upkeep glow step) has passed. Specifically, it is judged whether a counter, which count up at step S94 described later, has come to have a predetermined value. Here, when the judgment is YES, that is, in the case where the upkeep glow time has passed, the procedure proceeds to step S96, and the upkeep glow energization is turned off. Thereafter, the procedure returns to the main routine. On the other hand, at the step S92, when the judgment is NO, that is, in the case where the upkeep glow time has not passed, the procedure proceeds to step S93, and it is judged whether the pre-glow step is ended. That is, it is judged whether the pre-glow end flag is set. Here, when the judgment is NO, that is, in the case where the pre-glow step is not ended (in the case where the pre-glow end flag is cleared), the procedure proceeds to step S95, and the upkeep glow energization is turned off. Thereafter, the procedure returns to the main routine. On the other hand, at the step 593, in the case where the pre-glow step is ended (in the case where the pre-glow end flag is set), the procedure proceeds to the step S94, and the upkeep glow energization is turned on. In the upkeep glow energization, the PWM control is performed for the energization to the glow plug 1 according to the duty ratio Dh calculated at the step S5 to suppress the drop in the temperature of the sheath heater 2. Besides, at the step 94, as described before, the upkeep glow time is counted up. Thereafter, the procedure returns to the main routine.

After the step S9, the procedure proceeds to step S13. Then, at the step S13, it is judged whether 12.5 ms has passed. Here, when the judgment is YES, that is, in the case where 12.5 ms has passed, the procedure returns to the step S2. On the other hand, when the judgment is NO, that is, in the case where 12.5 ms has not passed, the step S13 is repeated until the time has passed.

The glow plug energization control apparatus of the invention performs the energization control as described above.

EXAMPLE

Figure 11:
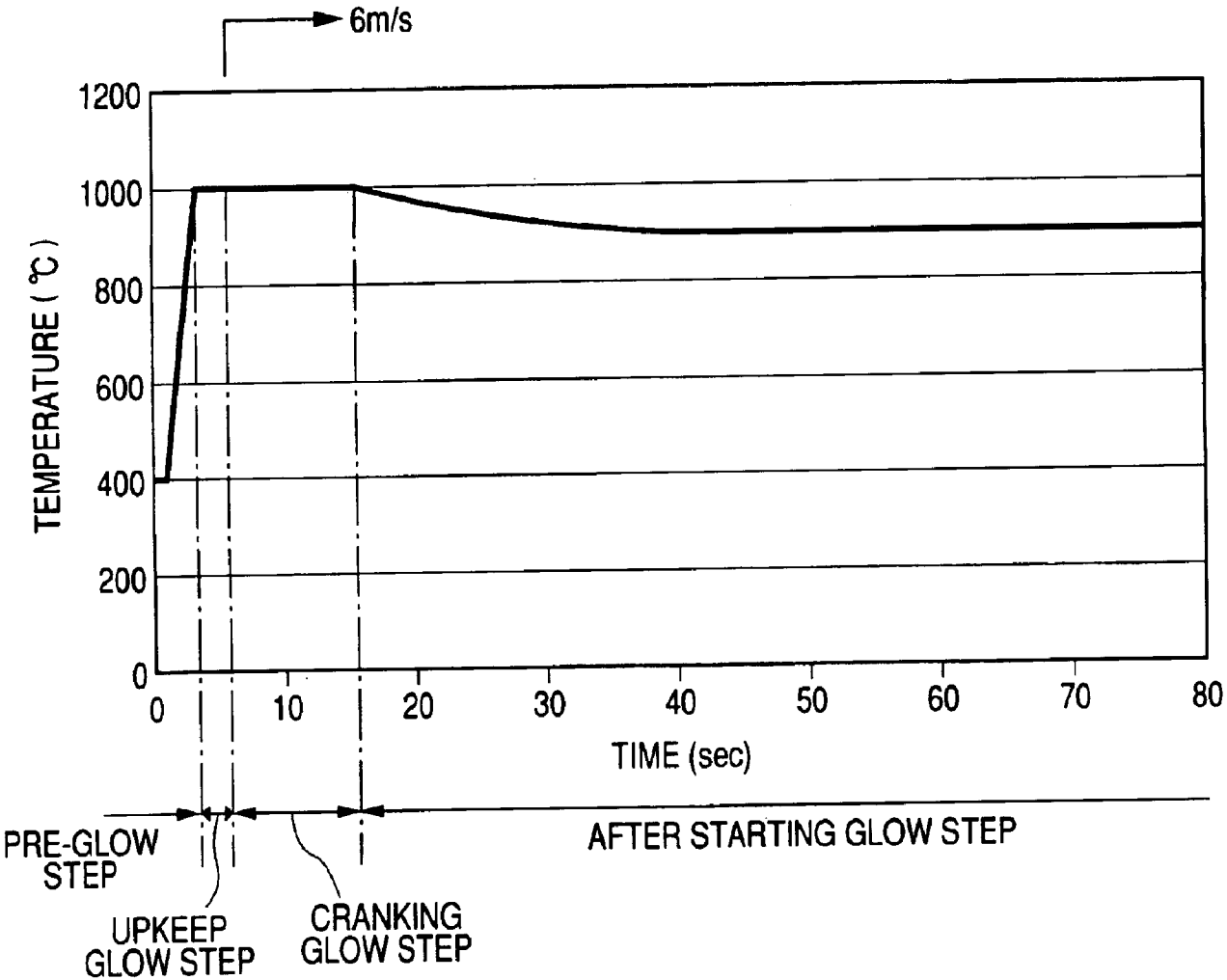
FIG. 11 is a graph showing the relation between the time after a key is put in an on position and the temperature of the glow plug in the embodiment.

Next, a specific example will be described. In this example, a description will be given to an energization control of the glow plug energization control apparatus 101 in a case where the operator puts the key switch KSW in the on position, and after a short time has passed, that is, after the sheath heater 2 is sufficiently heated, the key switch KSW is put in the start position. FIG. 11 shows the temperature change of the glow plug 1 when the glow plug energization control apparatus 101 of the invention is used. Incidentally, in this example, since a temperature not higher than 400° C. could not be measured, the temperature change not lower than 400° C. is shown. In this example, the glow plug 1 is mounted in the plug hole for test formed in the block made of carbon steel as described before, and a thermocouple is brought into contact with a portion of the sheath heater 2 positioned at the outside of the heat generating coil 21, and the temperature of the sheath heater 2 is measured. In this desk experiment, the pre-glow step and the upkeep glow step are put in a windless state, and the cranking glow step and the after starting glow step are put in a state in which an air blast at 6 m/s (strong wind) is sent by an air blower.

First, when the operator puts the key switch KSW in the on position, the pre-glow step starts, and the temperature of the sheath heater 2 is almost linearly raised up to the first target temperature (1000° C. in this example) by the energization control to the glow plug 1 by the pre-glow unit (see FIG. 11).

A description will be given along the foregoing flowcharts. When the key switch KSW is put in the on position, the procedure proceeds to the step S1, the glow plug energization control apparatus 101 is initialized, the pre-glow flag is set, and the pre-glow end flag, the start signal flag, and the after starting glow flag are cleared (see FIG. 4). Subsequently, although the procedure proceeds to the step S2, since energization to the glow plug 1 has not yet performed at this stage, the resistance value R is not calculated. Next, the procedure proceeds to the subroutine of the step S3 (see FIG. 5). At the step 331, since the pre-glow is being performed at present (the pre-glow flag is set) and the pre-glow step has not yet been ended (the pre-glow end flag is not set), the judgment is NO. Accordingly, the procedure returns to the main routine as it is. Next, although the procedure proceeds to the step S5, since energization to the glow plug 1 has not yet been performed at this stage, the duty ratio Dh at the upkeep glow step and the duty ratio Dk at the cranking glow step are not calculated. Next, although the procedure proceeds to the subroutine of the step S6, since energization to the glow plug 1 has not yet been performed at this stage, the resistance value R can not be obtained (see FIG. 6). Accordingly, the duty ratio Da at the after starting glow step is not calculated. Next, the procedure proceeds to the step S7 (see FIG. 4). At the step S7, since cranking is not being performed (since the start signal input flag is not set), the judgment is NO, and the procedure proceeds to the step S10.

Figure 9:
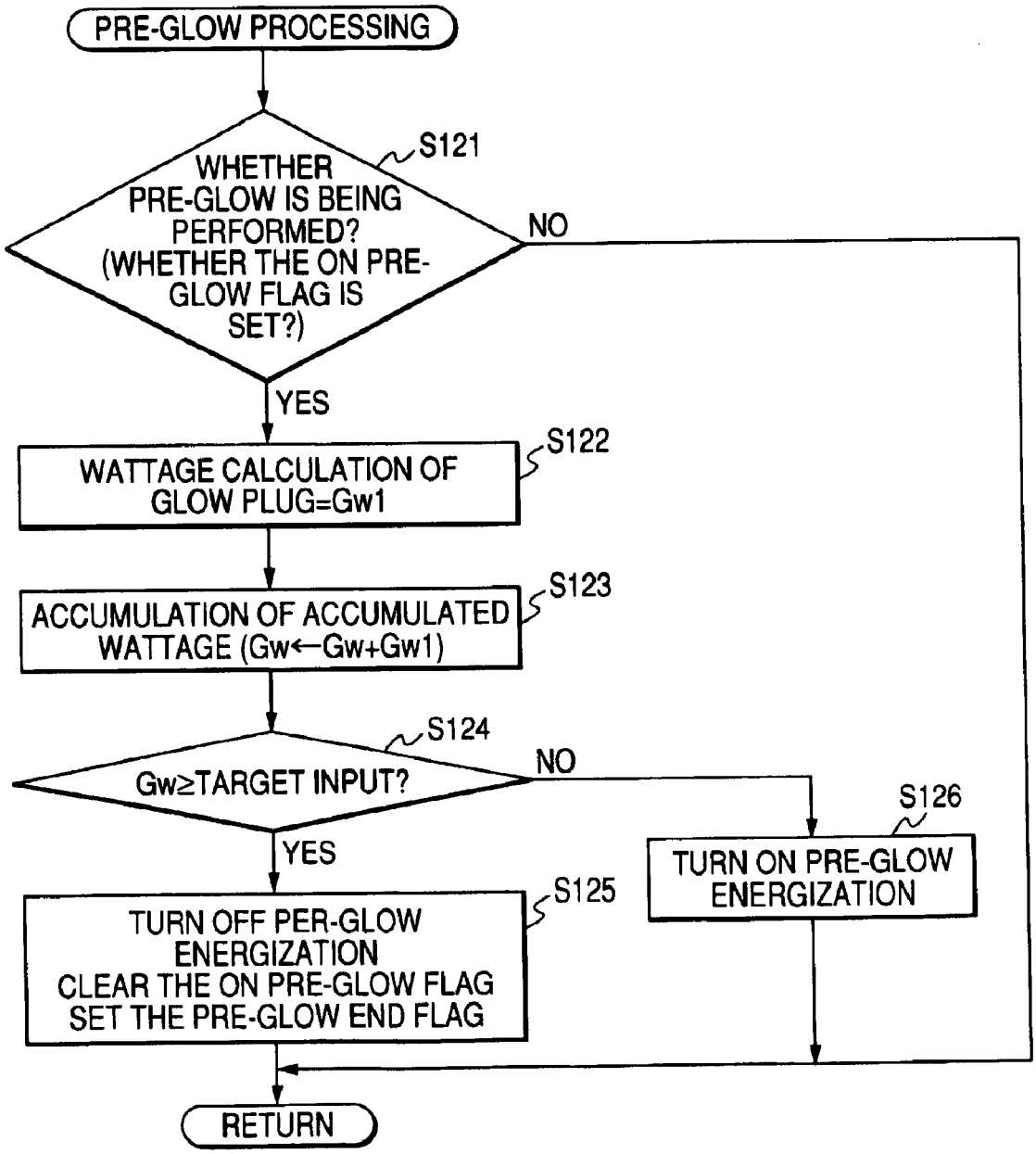
FIG. 9 is a flowchart showing a pre-glow processing in the energization control by the glow plug energization control apparatus of the embodiment.

At the step S10, since the alternator is not under operation, the judgment is NO, and the procedure proceeds to the subroutine of the step S12 (see FIG. 9). At the step 5121, since the pre-glow step is being performed (since the pre-glow flag is set), the judgment is YES, and the procedure proceeds to the step S122. At the step S122, since energization to the glow plug 1 has not yet been performed at this stage, the wattage is made GW1=0. Then, the procedure proceeds to the step S123. At the step S123, since the initial value of the accumulated wattage Gw is 0, and the applied wattage Gw1 is also 0, the accumulated wattage is made Gw=0. Subsequently, at the step S124, since the accumulated wattage Gw does not reach the target input, the judgment is NO, and the procedure proceeds to the step S126. Then, at the step S126, the pre-glow energization is turned on. That is, the continuous energization to the glow plug 1 from the battery BT is performed. Thereafter, the procedure returns to the main routine.

Figure 10:
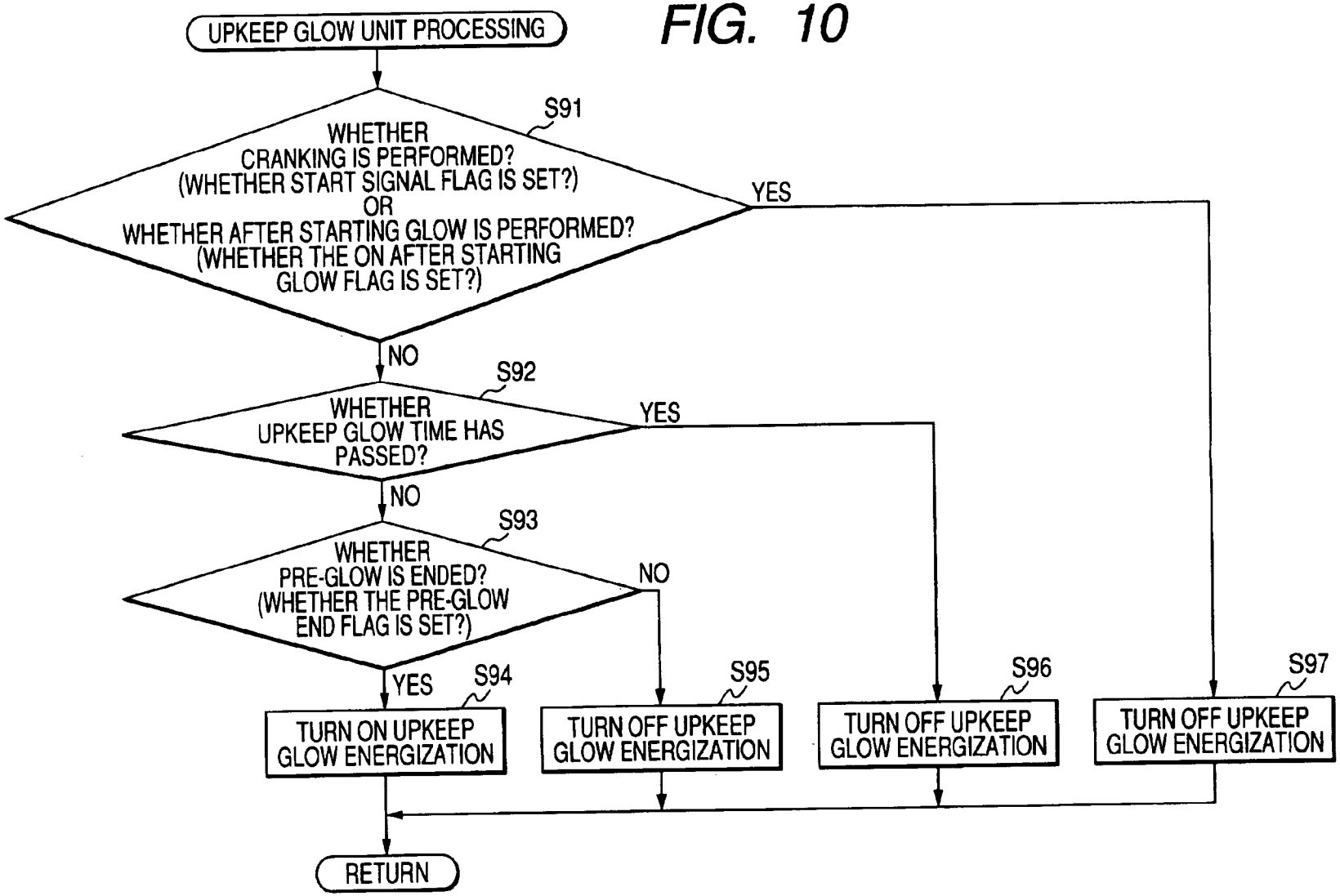
FIG. 10 is a flowchart showing a upkeep glow processing in the energization control by the glow plug energization control apparatus of the embodiment.

Next, the procedure proceeds to the subroutine of the step S9 (see FIG. 10). Then, at the step S91, since the cranking is not being performed (the start signal flag is not set) and the after starting glow is not also being performed (the on after glow flag is not also set), the judgment is NO, and the procedure proceeds to the step S92. At the step S92, since the upkeep glow step has not yet been performed, and the upkeep glow time has not passed, the judgment is NO, and the procedure proceeds to the step S93. At the step S93, since the pre-glow step is being performed at present, and the pre-glow step has not yet been ended (since the pre-glow end flag is not set), the judgment is NO, and the procedure proceeds to the step S95. At the step S95, the upkeep glow energization is turned off. Thereafter, the procedure returns to the main routine, and the procedure proceeds to the step S13 (see FIG. 4). Then, after 12.5 ms has passed, the procedure returns to the step S2.

Next, at the step S2, the voltage value applied to the glow plug 1 and the value of the current flowing to the glow plug 1 are captured, and the present resistance value R of the sheath heater 2 is calculated. Subsequently, although the procedure proceeds to the step S3, similarly to the above, the procedure returns to the main routine through the step S31 (see FIG. 5). Next, although the duty ratio Dh at the upkeep glow step and the duty ratio Dk at the cranking glow step are calculated at the step S5 as stated above, these duty ratios Dh and Dk are not used in this pre-glow step (see FIG. 4). Next, the procedure proceeds to the subroutine of the step S6, and the duty ratio Da at the after starting glow step is calculated through the step S61 to the step S63 (see FIG. 6). However, this duty ratio is not used in the pre-glow step. Next, the procedure proceeds to the step S7 (see FIG. 4). At the step S7, since the cranking is not being performed as stated above, the judgment is NO, and the procedure proceeds to the step S10.

At the step S10, since the alternator is not operated, the judgment is NO, and the procedure proceeds to the subroutine of the step S12 (see FIG. 9). At the step S121, since the pre-glow step is being performed as stated above, the judgment is YES, and the procedure proceeds to the step S122. At the step 5122, the wattage GW1 applied to the glow plug 1 during the period of one cycle is calculated. Subsequently, the procedure proceeds to the step S123. At the step S123, the accumulated wattage Gw is calculated. That is, the newly applied wattage Gw1 is added to the accumulated wattage Gw (here, 0) one cycle before to obtain the new accumulated wattage Gw. Next, at the step S124, since the accumulated wattage Gw has not yet reached the target input, the judgment is NO, and the procedure proceeds to the step S126. Then, at the step S126, the pre-glow energization is continuously turned on. Thereafter, the procedure returns to the main routine.

Next, the procedure proceeds to the subroutine of the step S9 (see FIG. 10). At the step S91, since the pre-glow step is being performed, the judgment is NO as stated above, and the procedure proceeds to the step S92. At the step S92, since the upkeep glow time has not passed, the judgment is NO, and the procedure proceeds to the step S93. Since the pre-glow step has not yet been ended at the step S93, the judgment is NO, and the procedure proceeds to the step S95. Then, the upkeep glow energization is continuously turned off. Thereafter, the procedure returns to the main routine, and proceeds to the step S13. Then, after 12.5 m has passed, the procedure returns to the step S2.

Thereafter, until the accumulated wattage Gw exceeds the target input (see the step S124 of FIG. 9), the above cycle is repeated for a while. Then, in the case where the accumulated wattage Gw exceeds the target input, the judgment is YES at the step S124, the procedure proceeds to the step S125, and the pre-glow energization is turned off. Besides, the pre-glow flag is cleared, while the pre-glow end flag is set. At this time, the temperature of the sheath heater 2 reaches the first target temperature (1000° C.) as shown in FIG. 11. Thereafter, the procedure returns to the main routine, and the procedure proceeds to the subroutine of the step S9 (see FIG. 10). At the step S91, similarly to the above, since the cranking is not being performed and the after starting glow is not also being performed, the judgment is NO, and the procedure proceeds to the step S92. At the step S92, since the upkeep glow time has not yet passed, the judgment is NO, and the procedure proceeds to the step S93. Then, at the step S93, differently from the above, since the pre-glow step is ended (since the pre-glow end flag is set), the judgment is YES and the procedure proceeds to the step S94.

Then, at the step S94, the upkeep glow energization is turned on. That is, here, the pre-glow step is shifted to the upkeep glow step. At this upkeep glow step, as shown in FIG. 11, the sheath heater 2 is kept at the first target temperature (1000° C.) in this step, and the drop of the temperature is prevented. In this upkeep glow energization, as described before, the PWM energization to the glow plug 1 is performed according to the duty ratio Dh. Thereafter, the procedure returns to the main routine and proceeds to the step S13 (see FIG. 4). Then, after 12.5 ms has passed, the procedure returns to the step S2.

Next, at the step S2, as stated above, the voltage value and the current value are captured, and the resistance value R of the glow plug 1 is calculated. Subsequently, the procedure proceeds to the subroutine of the step S3 (see FIG. 5). At the step S31, since the pre-glow step is ended (the pre-glow end flag is set), and the after starting glow step is not also being performed (since the after starting glow flag is cleared) differently from the above, the judgment is YES, and the procedure proceeds to the step S32. Then, after the start signal is captured at the step S32, the procedure proceeds to the step S33. However, when the operator has not yet put the key switch KSW in the start position, there is no continuous start signal input, and therefore, the judgment is NO. Then, the procedure proceeds to the step S35. At the step S35, since the start signal input is not continuously turned off for eight periods, the judgment is NO. Incidentally, since the start signal flag is cleared at the step S1, the cleared state is kept. Thereafter, the procedure returns to the main routine and proceeds to the step S5 (see FIG. 4). Then, the duty ratio Dh at the upkeep glow step and the duty ratio Dk at the cranking step are calculated. Next, the procedure proceeds to the subroutine of the step S6, and the duty ratio Da at the after starting glow step is calculated (see FIG. 6). However, this duty ratio Da is not used in the upkeep glow step.

Next, the procedure proceeds to the step S7, and since the cranking is not being performed, the judgment is NO, and the procedure proceeds to the step S10 (see FIG. 4). At the step S10, since the alternator is not under operation, the judgment is NO, and the procedure proceeds to the subroutine of the step S12 (see FIG. 9). At the step S121, since the pre-glow step has already been ended (since the pre-glow flag is cleared), differently from the above, the judgment is NO, and the procedure returns to the main routine as it is and proceeds to the subroutine of the step S9 (see FIG. 10). At the step S91, as described above, since the cranking is not being performed and the after starting glow is not also being performed, the judgment is NO, and the procedure proceeds to the step S92. At the step S92, since the predetermined upkeep glow time (30 seconds in this example) has not passed, the judgment is NO, and the procedure proceeds to the step S93. At the step S93, as stated above, since the pre-glow step is ended, the judgment is YES, and the procedure proceeds to the step S94. Then, at the step S94, the upkeep glow energization is continuously turned on. Thereafter, the procedure returns to the main routine and proceeds to the step S13 (see FIG. 4). Then, after 12.5 ms has passed, the procedure returns to the step S2.

Thereafter, the above cycle is repeated until the key switch KSW is continuously put in the start position for 0.1 second (see the step S33 of FIG. 5), or the predetermined upkeep glow time has passed (see the step S92 of FIG. 10).

In the case where the predetermined upkeep glow time has passed while the key switch KSW is not continuously put in the start position for 0.1 second, the judgment is YES at the step S92 shown in FIG. 10, and the procedure proceeds to the step S96. Then, at the step S96, the upkeep glow energization is turned off. That is, the upkeep glow step is ended. Thereafter, the procedure returns to the main routine and proceeds to the step S13 (see FIG. 4), and after 12.5 ms has passed, the procedure returns to the step S2.

On the other hand, in the case where the key switch KSW is continuously put in the start position for 0.1 second before the upkeep glow time has passed, since the continuous start signal input is recognized at the step S33 of the subroutine (see FIG. 5) of the step S3, the judgment is YES. Then, the procedure proceeds to the step S34, and the start signal flag is set. That is, here, the upkeep glow step is shifted to the cranking glow step. That is, the PWM control for the energization to the glow plug 1 is performed so that the temperature of the sheath heater 2 is kept at the first target temperature (1000° C.) during the period of cranking. As a result, as shown in FIG. 11, although air is sent, the temperature of the sheath heater 2 is not dropped and is kept at the first target temperature (1000° C.).

Next, at the step S5, the duty ratio Dh at the upkeep glow step and the duty ratio Dk at the cranking step are calculated on the basis of the voltage value applied to the glow plug 1 from the battery BT. Next, the procedure proceeds to the subroutine of the step S6 (see FIG. 6), and the duty ratio Da at the after starting glow step is calculated. However, in the cranking glow step, this duty ratio Da is not referred to. Next, the procedure proceeds to the step S7 (see FIG. 4). At the step S7, differently from the above, since the start signal flag is set at this stage, it is assumed that the cranking is being performed, and the judgment is YES. Then, the procedure proceeds to the subroutine of the step S8 (see FIG. 7). Then, at the step S81, cranking energization is turned on. In this cranking energization, as described before, the PWM energization to the glow plug 1 is performed according to the duty ratio Dk. Thereafter, the procedure returns to the main routine, and the procedure proceeds to the subroutine of the step S9 (see FIG. 10). At the step S91, differently from the above, since the cranking is being performed (since the start signal flag is set), the judgment is YES, and the procedure proceeds to the step S97. Then, at the step S97, the upkeep glow energization is turned off. Thereafter, the procedure returns to the main routine and proceeds to the step S13 (see FIG. 4). Then, after 12.5 ms has passed, the procedure returns to the step S2.

Next, at the step S2, as described above, the voltage value and the current value are captured, and the resistance value R of the glow plug 1 is calculated. Subsequently, the procedure proceeds to the subroutine of the step S3 (see FIG. 5). At the step S31, as described above, since the pre-glow step is ended and the after starting glow step is not also being performed, the judgment is YES, and the procedure proceeds to the step S32. At the step S32, since the continuous start signal input is recognized, the judgment is YES. Then, the procedure proceeds to the step S33, and the start signal flag is continuously set. Thereafter, the foregoing cycle is repeated until the cranking is ended, the engine is started, and the alternator is operated (see the step S10 of FIG. 4).

In the case where the engine is started, since the operator returns the key switch KSW from the start position to the on position, if the continuous start signal input for 0.1 second is not recognized at the step S33 of the subroutine of the step S3, the judgment is NO (see FIG. 5), and the judgment is YES at the step S35. Next, the procedure proceeds to the step S36, and the start signal flag is cleared. That is, here, the cranking glow step is shifted to the after starting glow step. That is, the PWM control is performed for the energization to the glow plug 1, so that the sheath heater 2 is made to have the second target temperature (900° C. in this example) and this is kept. As a result, as shown in FIG. 11, the temperature of the sheath heater 2 is gradually dropped from the first target temperature (1000° C.), and after it becomes the second target temperature (900° C.), this temperature is kept.

Next, although the duty ratio Dh at the upkeep glow step and the duty ratio Dk at the cranking glow step are respectively calculated at the step S5, these duty ratios Dh and Dk are not referred to in the after starting glow step (see FIG. 4). Next, the procedure proceeds to the subroutine of the step S6 (see FIG. 6). Then, as described before, the duty ratio Da at the after starting glow step is calculated through the step S61 to the step S63. Next, the procedure proceeds to the step S7, and since the cranking is not being performed and the start signal input flag has been already cleared, the judgment is NO, and the procedure proceeds to the step S10 (see FIG. 4). At the step S10, since the alternator is operated by the starting of the engine, the judgment is YES, and the procedure proceeds to the subroutine of the step S11 (see FIG. 8). At the step S111, since the predetermined time (180 seconds in this example) of the after starting glow step has not passed, the judgment is NO, and the procedure proceeds to the step S112. Then, at the step S112, the after starting glow energization is turned on. Besides, the after starting glow flag is set. In the after starting glow energization, as described before, the PWM control is performed for the energization to the glow plug 1 so that in the case where the temperature of the sheath heater 2 has not yet become the second target temperature (900° C.), it comes to have the second target temperature, and the PWM control is performed for the energization to the glow plug 1 so that in the case where it has already become the second target temperature, this temperature is kept. Thereafter, the procedure returns to the main routine and proceeds to the subroutine of the step S9 (see FIG. 10). At the step S91, the after starting glow flag is set, and since the after starting glow is being performed, the judgment is YES, and the procedure proceeds to the step S97. Then, the upkeep glow energization is turned off. Thereafter, the procedure returns to the main routine and proceeds to the step S13 (see FIG. 4), and after 12.5 ms has passed, the procedure returns to the step S2.

Then, at the step S2, as stated above, the voltage value and the current value are captured, and the resistance value R of the glow plug 1 is calculated.

Figure 8:
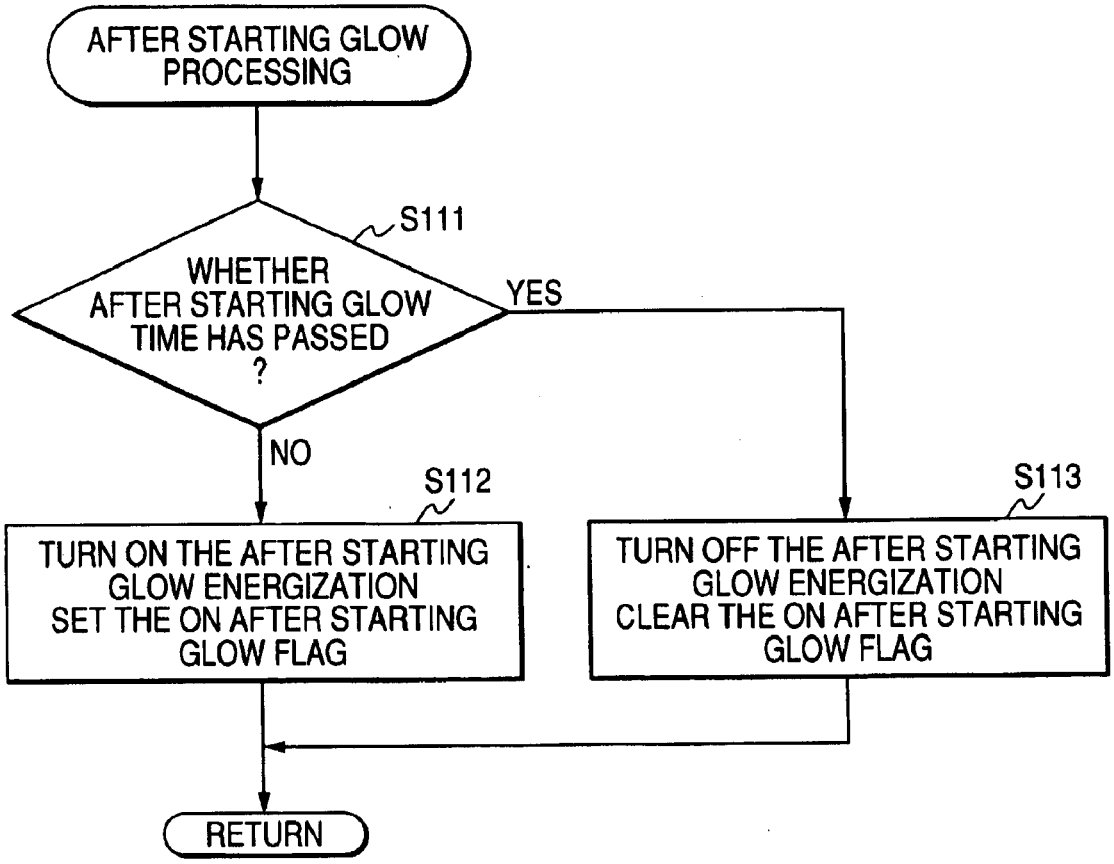
FIG. 8 is a flowchart showing an after starting glow processing in the energization control by the glow plug energization control apparatus of the embodiment.

Thereafter, the above cycle is repeated until the after starting glow time has passed (see the step S111 of FIG. 8). When the after starting glow time has passed, the judgment is YES at the step S111 of the subroutine of the step S1, and the procedure proceeds to the step S113. Then, at the step S113, the after starting glow energization is turned off. Besides, the after starting glow flag is cleared. By this, the after starting glow step is ended. That is, the energization control of the glow plug 1 by the glow plug energization control apparatus 101 of the invention is ended.

As described above, in this embodiment, the glow plug energization control apparatus 101 includes the four units, that is, the pre-glow unit, the upkeep glow unit, the cranking glow unit and the after starting glow unit.

Among these, the pre-glow unit is for controlling the energization to the glow plug 1 so that when the key switch KSW is put in the on position, the temperature of the sheath heater 2 is quickly raised. By including the unit as stated above, when the key switch KSW is put in the on position, the average power is set to be larger than that in the other units, and the energization to the glow plug 1 can be performed. Accordingly, the temperature of the sheath heater 2 can be efficiently raised.

Subsequently to the energization control performed by the pre-glow unit, the upkeep glow unit calculates the duty ratio Dh of the voltage waveform applied to the glow plug 1 on the basis of the voltage value applied to the glow plug 1 from the battery BT, and performs the PWM control for the energization to the glow plug 1 according to this duty ration Dh. By including the unit as stated above, the energization to the glow plug 1 can be controlled in expectation of the occurrence of heat conduction from the sheath heater 2 to the surrounding after the energization control performed by the pre-glow unit. Further, the PWM control has a merit that the applied electric power to the glow plug can be easily adjusted according to the duty ratio Dh. Accordingly, the drop in the temperature of the sheath heater 2 is prevented, and the startability of the engine can be improved.

The cranking glow unit is for calculating, when the key switch KSW is put in the start position during the energization control performed by the upkeep glow unit and the cranking of the engine is started, the duty ratio Dk of the voltage waveform applied to the glow plug 1 is calculated on the basis of the voltage value applied to the glow plug 1 from the battery BT during the cranking period. Besides, this unit is for performing the PWM control for the energization to the glow plug 1 according to the duty ratio Dk larger than the virtual duty ratio Dhh calculated by the upkeep glow unit when it is assumed that the voltage value of the battery BT in the control period of the upkeep glow unit is equal to the voltage value of the battery BT in the control period of this unit. By including the unit as stated above, the energization to the glow plug 1 can be controlled in expectation of the temperature drop of the sheath heater 2 occurring during the cranking period. Further, the PWM control has a merit that the applied electric power to the glow plug 1 can be easily adjusted according to the duty ratio Dk. Accordingly, even during the cranking period, it is possible to prevent the drop in the temperature of the sheath heater 2 and to improve the startability of the engine.

The after starting glow unit supplies the electric power, which is lower than the electric power supplied to the glow plug 1 by the pre-glow unit, to the glow plug 1 after the engine is started, and realizes the stable heating of the sheath heater 2. By the unit as stated above, since the sheath heater 2 can be stably heated also after the starting of the engine, the warm-up in the combustion chamber of the engine can be accelerated, and it is possible to prevent the occurrence of diesel knock and to suppress the occurrence of noise and white smoke, the exhaustion of HC composition, and the like.

Further, the pre-glow unit of this embodiment controls the energization to the glow plug 1 until the accumulated wattage to the glow plug 1 becomes the predetermined value corresponding to the first target temperature. When the control is performed through the accumulated wattage as stated above, the temperature of the sheath heater 2 can be raised up to the first target temperature more accurately, and insufficient preheating of the sheath heater 2 and excessive preheating thereof can be effectively suppressed.

Furthermore, the pre-glow unit of this embodiment performs continuous energization to the glow plug 1. By performing the continuous energization as stated above, the temperature of the sheath heater 2 can be raised up to the first target temperature more efficiently and in a short time.

Furthermore, the upkeep glow unit of this embodiment stops the energization to the glow plug 1 when the key switch KSW is not put in the start position in the predetermined time after the energization control by this was started. By this, the load applied to the glow plug 1 and the battery BT can be reduced and these can be protected.

Furthermore, the after starting glow unit of this embodiment controls the energization to the glow plug 1 so that the temperature of the sheath heater 2 becomes the second target temperature and this is kept. By this, also after the engine is started, the temperature of the sheath heater 2 is made to become the second target temperature and this can be kept, so that the warm-up in the combustion chamber of the engine can be accelerated more effectively, and it is possible to prevent the occurrence of diesel knock, and to suppress the occurrence of noise and white smoke, the ejection of HC composition, and the like.

Furthermore, the after starting glow unit of this embodiment calculates the duty ratio Da of the voltage waveform applied to the glow plug 1 on the basis of the resistance value of the sheath 2, and the PWM control for the energization to the glow plug 1 is performed by this. The PWM control has a merit that the applied electric power to the glow plug can be easily adjusted according to the duty ratio. Here, during the control period of the after starting glow unit, since there is a case where the temperature of the sheath heater 2 is dropped by external factors such as burning spray or swirl, it is necessary to stably heat the sheath heater 2 in expectation of this. On the other hand, since the resistance value of the sheath heater 2 during the control period of the after starting glow unit is in a steady state corresponding to the temperature, that is, there is a correlation between the resistance value of the sheath heater 2 and its temperature, when the duty ratio Da calculated on the basis of the resistance value is used, the heater temperature can be made the second target temperature more accurately, and this can be stably kept.

Furthermore, when the difference $\Delta R$ of the resistance value of the sheath heater 2 is given by $\Delta R = Rt - R$, and the control effective voltage value Vc is given by $Vc = K_0 + K_1 \Delta R + K_2 \int \Delta R dt$, the after starting glow unit of this embodiment includes the calculation unit for calculating the duty ratio Da in accordance with $Da = Vc^2/Vb^2$. When the duty ratio Da is calculated in this way and the energization to the glow plug 1 is controlled, the temperature of the sheath heater 2 during the control performed by the after starting glow unit can be made to become the second target temperature more accurately, and this can be kept more stably.

Furthermore, this embodiment includes the pre-glow priority unit by which when the key switch is put in the start position during the control performed by the pre-glow unit and the cranking of the engine is started, after the control performed by the pre-glow unit is ended, it is shifted to the control performed by the cranking glow unit. Thus, since the control by the cranking unit is performed after the control performed by the pre-glow unit is ended and the sheath heater 2 is sufficiently heated, the engine can be certainly started in a short time.

Although the present invention has been described in line with the embodiment and the example, the invention is not limited to the foregoing embodiment, and it is needless to say that the invention can be suitably modified within the range not deviating from the gist thereof.

The entire disclosure of each and every foreign patent application from which the benefit of foreign priority has been claimed in the present application is incorporated herein by reference, as if fully set forth.

What is claimed is:

1. A glow plug energization control apparatus for controlling energization from a battery to a glow plug having a resistance heater installed in an engine when a key switch is put in an on position or a start position, the glow plug energization control apparatus comprising:

a pre-glow unit for controlling the energization to the glow plug to quickly raise temperature of the resistance heater when the key switch is put in the on position;

an upkeep glow unit for calculating a duty ratio Dh of a voltage waveform applied to the glow plug on the basis of a voltage value applied to the glow plug from the battery subsequently to the energization control performed by the pre-glow unit and for performing PWM control for the energization to the glow plug according to the duty ratio Dh;

a cranking glow unit for calculating, in a period of a cranking started by putting the key switch in the start position during the energization control performed by the upkeep glow unit, a duty ratio Dk of a voltage waveform applied to the glow plug on the basis of a voltage value applied to the glow plug from the battery and for performing PWM control for the energization to the glow plug according to the duty ratio Dk larger than a virtual duty ratio Dhh calculated by the upkeep glow unit when it is assumed that the voltage value of the battery in a control period of the upkeep glow unit is equal to the voltage value of the battery in a control period of the cranking glow unit; and an after starting glow unit for, after the engine is started, supplying an electric power, which is lower than an electric power supplied to the glow plug by the pre-glow unit, to the glow plug to realize stable heating of the resistance heater.

2. A glow plug energization control apparatus according to claim 1, wherein the pre-glow unit controls the energization to the glow plug until an accumulated wattage applied to the glow plug becomes a predetermined value corresponding to the first target temperature.

3. A glow plug energization control apparatus according to claim 1, wherein the pre-glow unit continuously performs the energization to the glow plug during the control period.

4. A glow plug energization control apparatus according to claim 1, wherein when the key switch is not put in the start position in a predetermined time from the start of the energization control performed by the upkeep glow unit, the upkeep glow unit stops the energization to the glow plug.

5. A glow plug energization control apparatus according to claim 1, wherein the after starting glow unit controls the energization to the glow plug to make the temperature of the resistance heater a second target temperature and to keep this.

6. A glow plug energization control apparatus according to claim 5, wherein the after starting glow unit calculates a duty ratio Da of the voltage waveform applied to the glow plug on the basis of a resistance value of the resistance heater, and performs PWM control for the energization to the glow plug according to the duty ratio Da.

7. A glow plug energization control apparatus according to claim 1, further comprising a pre-glow priority unit which, when the key switch is put in the start position during the energization control performed by the pre-glow unit, waits for ending of the energization control performed by the pre-glow unit and shifts it to energization control performed by the cranking glow unit.

8. A glow plug energization control method for controlling energization from a battery to a glow plug having a resistance heater installed in an engine when a key switch is put in an on position or a start position, the glow plug energization control method comprising:

a pre-glow step of controlling the energization to the glow plug to quickly raise temperature of the resistance heater when the key switch is put in the on position;

a upkeep glow step of calculating a duty ratio Dh of a voltage waveform applied to the glow plug on the basis of a voltage value applied to the glow plug from the battery subsequently to the pre-glow step and for performing PWM control for the energization to the glow plug according to the duty ratio Dh;

a cranking glow step of calculating, in a period of a cranking started by putting the key switch in the start position in the upkeep glow step, a duty ratio Dk of a voltage waveform applied to the glow plug on the basis of a voltage value applied to the glow plug from the battery and performing PWM control for the energization to the glow plug according to the duty ratio Dk larger than a virtual duty ratio Dhh calculated in the upkeep glow step when it is assumed that the voltage value of the battery in the upkeep glow step is equal to the voltage value of the battery in the cranking glow step; and an after starting glow step of supplying, after the engine is started, an electric power, which is lower than an electric power supplied to the glow plug in the pre-glow step, to the glow plug to realize stable heating of the resistance heater.

9. A glow plug energization control method according to claim 8, wherein at the pre-glow step, the energization to the glow plug is controlled until an accumulated wattage to the glow plug becomes a predetermined value corresponding to a first target temperature.

10. A glow plug energization control method according to claim 8, wherein at the pre-glow step, continuous energization to the glow plug is performed.

11. A glow plug energization control method according to claim 8, wherein at the upkeep glow step, when the key switch is not put in the start position in a predetermined time from the start of the upkeep glow step, the energization to the glow plug is stopped.

12. A glow plug energization control method according to claim 8, wherein at the after starting glow step, the energization to the glow plug is controlled to make the temperature of the resistance heater a second target temperature and to keep this.

13. A glow plug energization control method according to claim 12, wherein at the after starting glow step, a duty ratio Da of the voltage waveform applied to the glow plug is calculated on the basis of a resistance value of the resistance heater, and PWM control for the energization to the glow plug is performed according to the duty ratio Da.

14. A glow plug energization control method according to claim 8, wherein, when the key switch is put in the start position in the pre-glow step, after the pre-glow step has been ended, it is shifted to the cranking glow step.

* * * * *